US011746585B2

(12) United States Patent
Kobayashi et al.

(10) Patent No.: US 11,746,585 B2
(45) Date of Patent: Sep. 5, 2023

(54) CONNECTION MEMBER FOR CONSTRUCTION MATERIALS, CONNECTING FITTING THEREFOR, CONNECTING STRUCTURE THEREFOR, AND CONNECTING METHOD THEREFOR

(71) Applicant: BUNKA SHUTTER CO., LTD., Tokyo (JP)

(72) Inventors: Masanori Kobayashi, Tokyo (JP); Shigeo Yamagami, Tokyo (JP); Katsuhiko Murakami, Tokyo (JP)

(73) Assignee: BUNKA SHUTTER CO., LTD., Tokyo (JP)

( * ) Notice: Subject to any disclaimer, the term of this patent is extended or adjusted under 35 U.S.C. 154(b) by 288 days.

(21) Appl. No.: 17/257,614

(22) PCT Filed: Jul. 2, 2019

(86) PCT No.: PCT/JP2019/026256
§ 371 (c)(1),
(2) Date: Jan. 4, 2021

(87) PCT Pub. No.: WO2020/009101
PCT Pub. Date: Jan. 9, 2020

(65) Prior Publication Data

US 2021/0140225 A1 May 13, 2021

(30) Foreign Application Priority Data

Jul. 5, 2018 (JP) ..... 2018-128165

(51) Int. Cl.
*E06B 1/60* (2006.01)

(52) U.S. Cl.
CPC ..... *E06B 1/603* (2013.01)

(58) Field of Classification Search
CPC ... E06B 1/603; E06B 1/52; E06B 1/56; E06B 1/6038; E06B 1/6046; E06B 1/6053;
(Continued)

(56) References Cited

U.S. PATENT DOCUMENTS 1,458,025 A * 6/1923 Biele ..... E06B 1/18 52/217
1,718,813 A * 6/1929 Iras ..... E06B 1/08 49/505

(Continued)

FOREIGN PATENT DOCUMENTS

CN 2744811 Y 12/2005
CN 101498399 A 8/2009

(Continued)

OTHER PUBLICATIONS

Office Action issued by the China National Intellecutal Property Administration in relation to Chinese Application No. 201980045119.1 dated Jun. 1, 2022 (7 pages) along with English language translation (7 pages).

(Continued)

*Primary Examiner* — James M Ference
(74) *Attorney, Agent, or Firm* — Robert P. Michal, Esq.; Carter, DeLuca & Farrell LLP

(57) ABSTRACT

A first end portion of a connecting part of a connecting member reaches a locked member arranged such that the thickness direction of one of two construction materials is an axial direction N, and a second end portion of the connecting part reaches the other one of the two construction materials. The second end portion is formed to have a torsion angle α as an inclination angle to the axial direction N. When the second end portion is coupled with the other construction material by a coupling fitting, the torsion angle α reduces or disappears, a torsion angle to the axial direction N is generated in the first end portion, the first end portion locks (Continued)

on the locked member, and the connecting member connects the two construction materials.

14 Claims, 22 Drawing Sheets

(58) Field of Classification Search
CPC .... E06B 1/6061; E06B 1/6069; E06B 1/6076; E06B 1/62; E06B 1/70
See application file for complete search history.

(56) References Cited

U.S. PATENT DOCUMENTS

| | | | | | |
|---|---|---|---|---|---|
| 2,284,074 | A * | 5/1942 | Stahl | E06B 1/18 | 52/211 |
| 2,859,491 | A * | 11/1958 | Morris, Jr. | E06B 1/08 | 49/467 |
| 3,250,049 | A * | 5/1966 | Sklar | E06B 1/6061 | 52/211 |
| 3,518,794 | A * | 7/1970 | William | E06B 1/045 | 49/505 |
| 3,571,996 | A * | 3/1971 | Braswell | E06B 3/9885 | 49/505 |
| 3,585,770 | A * | 6/1971 | Maizler | E06B 1/6061 | 403/231 |
| 3,685,226 | A * | 8/1972 | Richter | E06B 1/603 | 49/505 |
| 3,906,671 | A * | 9/1975 | Maldonado | E06B 1/20 | 49/505 |
| 4,128,977 | A * | 12/1978 | Schubeis | E06B 1/20 | 52/212 |
| 4,453,346 | A * | 6/1984 | Powell | E06B 1/6076 | 49/404 |
| 4,873,804 | A * | 10/1989 | Kukke | E06B 1/6076 | 411/116 |
| 5,655,343 | A * | 8/1997 | Seals | E06B 1/6069 | 52/745.15 |
| 6,216,402 | B1 * | 4/2001 | Van de Laar | E06B 1/6069 | 52/204.56 |
| 8,806,812 | B2 * | 8/2014 | Kolovich | E06B 1/6046 | 52/126.4 |
| 2008/0075556 | A1 * | 3/2008 | Smith | F16B 5/0233 | 411/379 |
| 2012/0211636 | A1 * | 8/2012 | Sirek | E06B 3/96 | 248/544 |
| 2014/0260008 | A1 * | 9/2014 | Eis | E04F 21/0015 | 52/749.1 |
| 2018/0187475 | A1 * | 7/2018 | Mitchell | E04F 21/0015 | |
| 2021/0140225 | A1 * | 5/2021 | Kobayashi | E06B 1/52 | |

FOREIGN PATENT DOCUMENTS

| | | | |
|---|---|---|---|
| CN | 207749946 | U | 8/2018 |
| DE | 8400332 | U1 | 3/1984 |
| EP | 0969177 | A1 | 1/2000 |
| JP | S4854432 | U | 7/1973 |
| JP | S4874432 | U | 9/1973 |
| JP | S5079224 | U | 7/1975 |
| JP | S5214368 | Y | 3/1977 |
| JP | S547147 | B2 | 4/1979 |
| JP | S54182561 | U | 12/1979 |
| JP | S54182562 | U | 12/1979 |
| JP | S553904 | A | 1/1980 |
| JP | S56100671 | U | 8/1981 |
| JP | S56100672 | U | 8/1981 |
| JP | S56100684 | U | 8/1981 |
| JP | S56107069 | U | 8/1981 |
| JP | S5980082 | U | 5/1984 |
| JP | S5982184 | U | 6/1984 |
| JP | S59233085 | A | 12/1984 |
| JP | H06-010585 | U | 2/1994 |
| JP | H07229354 | A | 8/1995 |
| JP | 913800 | A | 1/1997 |
| JP | 09184397 | A | 7/1997 |
| JP | 2006307633 | A | 11/2006 |
| JP | 2012154084 | A | 8/2012 |
| JP | 2015071863 | A | 4/2015 |
| JP | 2015224482 | A | 12/2015 |
| JP | 2017115462 | A | 6/2017 |
| JP | 2017115463 | A | 6/2017 |
| JP | 2019011667 | A | 1/2019 |
| JP | 2020007748 | A | 1/2020 |
| KR | 10-2009-0008920 | A | 1/2009 |
| KR | 20120084488 | A * | 7/2012 |
| TW | M488540 | U | 10/2014 |

OTHER PUBLICATIONS

Extended European Search Report issued by the European Patent Office in relation to European Application No. 19830876.9 dated Nov. 23, 2021 (8 pages).
Extended European Search Report issued by the European Patent Office in relation to European Application No. 19 83 0020 dated Nov. 23, 2021 (10 pages).
Notice of Reasons for Refusal issued by the Japanese Patent Office in relation to Japanese Application No. 2020-122849 dated Mar. 8, 2022 (4 pages) along with English language translation (4 pages).
Notice of Reasons for Refusal issued by the Japanese Patent Office in relation to Japanese Application No. 2020-122848 dated Mar. 8, 2022 (6 pages) along with English language translation (5 pages).
Notice of Reasons for Refusal issued by the Japanese Patent Office in relation to Japanese Application No. 2020-122847 dated Mar. 8, 2022 (7 pages) along with English language translation (7 pages).
Microfilm of Japanese Utility Model Application No. S54-182564.
Microfilm of Japanese Utility Model Application No. S54-182561.
Microfilm of Japanese Utility Model Application No. S57-176414.
Microfilm of the specification and drawings annexed to the request of Japanese Utility Model Application No. 119145/1971 (Laid-open No. 74432/1973) (KIMURA, Yutaka) Sep. 17, 1973, entire text, all drawings Reference JPS48-074432U (6 pages).
International Search Report issued by the Japanese Patent Office acting as the International Searching Authority in Yelation to International Application No. PCT/JP2019/026256 dated Sep. 10, 2019 along with English language translation (4 pages).
Written Opinion of the International Searching Authority issued by the Japanese Patent Office acting as the International Searching Authority in relation to International Application No. PCT/JP2019/026256 dated Sep. 10, 2019 along with English language translation (9 pages).
International Preliminary Report on Patentability issued by the International Bureau of WIPO in relation to International Application No. PCT/JP2019/026256 dated Jan. 14, 2021 along with English language translation (12 pages).
Office Action issued by the China National Intellectual Property Administration in relation to Chinese Application No. 201980095214.2 dated Oct. 8, 2022 (8 pages) along with English translation (5 pages).
Office Action issued by the Japanese Patent Office in relation to Japanese Application No. 2020-167423 dated Jul. 27, 2021 (4 pages) along with English language translation (4 pages).
Notice of Reasons for Refusal issued by the Japanese Patent Office in relation to Japanese Application No. 2018-128166 dated Feb. 15, 2022 (4 pages) along with English language translation (4 pages).
Notice of Reasons for Refusal issued by the Japanese Patent Office in relation to Japanese Application No. 2020-021530 dated Apr. 27, 2021 (3 pages) along with English language translation (3 pages).
Microfilm of the specification and drawings annexed to the request of Japanese Utility Model Application No. 11745/1986 (Laid-open No. 124184/1987) (Shin Nikkei Company, Ltd.) Aug. 6, 1987, entire text, all drawings (Family: none) English translation (26 pages).
Microfilm of the specification and drawings annexed to the request of Japanese Utility Model Application No. 36108/1978 (Laid-open No. 4215/1980) (Mitsui Keikinzoku Kakou KK) Jan. 11, 1980, entire text, all drawings (Family: none) English translation (19 pages).

(56) References Cited

OTHER PUBLICATIONS

Microfilm of the specification and drawings annexed to the request of Japanese Utility Model Application No. 119145/1971 (Laid-open No. 74432/1973) (Kimura, Yutaka) Sep. 17, 1973, entire text, in particular, specification, p. 1, lines 3-5, p. 2, lines 1-23, all drawings.
Microfilm of the specification and drawings annexed to the request of Japanese Utility Model Application No. 177815/1982 (Laid-open No. 82184/1984) (The Yamazaki Corporation) Jun. 2, 1984, entire text, all drawings.
Microfilm of the specification and drawings annexed to the request of Japanese Utility Model Application No. 134029/1973 (Laid-open No. 79224/1975) (Sankyo Aluminum Kogyo KK) Jul. 9, 1975, entire text, fig. 1-4, 6-10.
Search Report of TW Patent Applcation No. 109127359 dated Jul. 15, 2022 (1 page) along with English language translation (1 page).
Office Action issued by the The Intellectual Property Office Ministry of Economic Affairs, in relation to Taiwanese Application No. 109127359 dated Jul. 19, 2022 (6 pages) along with English language translation (4 pages).
Microfilm of Japanese Utility Model Application No. S46-119145.
Microfilm of Japanese Utility Model Application No. S46-97756.
Notice of Reasons for Refusal issued by the Japanese Patent Office in relation to Japanese Application No. 2020-122946 dated Mar. 15, 2022 (5 pages) along with English language translation (5 pages).
Notice of Reasons for Refusal issued by the Japanese Patent Office in relation to Japanese Application No. 2020-022040 dated Mar. 15, 2022 (4 pages) along with English language translation (4 pages).

* cited by examiner

CONNECTION MEMBER FOR CONSTRUCTION MATERIALS, CONNECTING FITTING THEREFOR, CONNECTING STRUCTURE THEREFOR, AND CONNECTING METHOD THEREFOR

CROSS-REFERENCE TO RELATED APPLICATIONS

This application is a national phase entry under 35 U.S.C. 371 of PCT International Application No. PCT/JP2019/026256 filed Jul. 2, 2019, which claims priority to Japanese Patent Application No. 2018-128165, filed Jul. 5, 2018, the disclosure of each of these applications is expressly incorporated herein by reference in their entirety.

TECHNICAL FIELD

The present invention relates to a connecting member, a connecting fitting therefor, a connecting structure therefor, and a connecting method therefor, and more particularly, to a connecting member for construction materials, a connecting fitting therefor, a connecting structure therefor, and a connecting method therefor that can be used to connect two construction materials spaced apart from each other, more specifically, a construction material on the side of a skeleton such as a wall, and an apparatus-side construction material such as an opening frame, e.g., a door frame of a hinged door apparatus, a sliding door apparatus, or the like.

BACKGROUND ART

Patent literature 1 below discloses that a door frame as a doorway is arranged in a wall as a skeleton of a building. In this example, the inside of the door frame is opened and closed by a hinged door.

RELATED ART LITERATURE

Patent Literature

Patent Literature 1: Japanese Utility Model Laid-Open no. 6-10585

DISCLOSURE OF INVENTION

Problem to be Solved by the Invention

The work for arranging an opening frame such as a door frame in a wall includes a work for arranging an opening frame as a construction material for a hinged door with an interval from a skeleton-side construction material formed on the wall side, and connecting the skeleton-side construction material and the opening frame by using a connecting member.

It is an object of the present invention to provide a connecting member for construction materials, a connecting fitting therefor, a connecting structure therefor, and a connecting method therefor that make it possible to easily perform the work for connecting two construction materials spaced apart from each other within a short time by improving the workability.

Means of Solution to the Problem

A connecting member for construction materials according to the present invention is a connecting member for construction materials, which connects two construction materials arranged with an interval therebetween, the connecting member including a connecting part including a first end portion reaching a locked member arranged in one construction material of the two construction materials such that a thickness direction of the one construction material, which is perpendicular to a direction of the interval, is an axial direction, and a second end portion reaching the other construction material of the two construction materials, wherein the second end portion is formed to have a torsion angle $\alpha$ s an inclination angle to a direction perpendicular to the axial direction of the locked member, and, when the second end portion is coupled with the other construction material and the torsion angle of the second end portion reduces or disappears, a torsion angle as an inclination angle to a direction perpendicular to the axial direction can be generated in the first end portion, and the first end portion locks on the locked member due to the generation of the torsion angle, thereby connecting the two construction materials.

In the connecting member for construction materials according to the present invention as described above, the second end portion, on the side of the other construction material, of the connecting part is formed to have a torsion angle $\alpha$ s an inclination angle to a direction perpendicular to the axial direction of the locked member. Therefore, when the second end portion is coupled with the other construction material by the coupling fitting and the torsion angle of the second end portion reduces or disappears, a torsion angle as an inclination angle to a direction perpendicular to the axial direction is generated in the first end portion, on the side of one construction material, of the connecting part. Due to the generation of this torsion angle, the first end portion locks on the locked member arranged in one construction material, and the two construction materials are connected. Accordingly, by performing the work for coupling the second end portion, of the two end portions of the connecting part, with the other construction material by the coupling fitting, the work for connecting the two construction materials so that they are immobile in the axial direction of the locked member is spontaneously performed. This makes it possible to easily perform the work for connecting two construction materials spaced apart from each other within a short time, thereby improving the workability.

In the connecting member for construction materials according to the present invention described above, the first end portion can be locked by the locked member by, e.g., forming an insertion portion for inserting the locked member in the first end portion.

This insertion portion can be a hole and can also be a notch such as a recess.

In the connecting member for construction materials according to the present invention, the connecting part can be one part, but it is also possible to form two connecting parts in the axial direction of the locked member. In addition, when arranging the two connecting parts in the axial direction of the locked member, the two connecting parts can be coupled with each other by a bridge part having a widthwise dimension in the axial direction of the locked member.

When coupling the two connecting parts by the bridge part having the widthwise dimension in the axial direction of the locked member, the directions of the torsion angles of the second end portions of the two connecting parts can the either the same direction or opposite directions.

Also, when coupling the two connecting parts by the bridge part having the widthwise dimension in the axial direction of the locked member, a strength decreasing portion for decreasing the strength of the bridge part can be formed in the bridge part.

In this case, when the two end portions of the two connecting parts are coupled with the other construction material by the coupling fittings, the torsion angles reduce or disappear, so the bridge part causes deformation such as curving, and a torsion angle with which the first end portion locks on the locked portion is generated in each of the first end portions of the two connecting parts. In this case, when the strength decreasing portion for decreasing the strength of the bridge part is formed in the bridge part, the bridge part easily causes deformation such as curving, so each end portion on the side of one construction material can be locked by the locked member more reliably.

This strength decreasing portion can be, e.g., a hole such as an elongated hole or a round hole formed in the bridge part, a notch such as a recess, or a thin portion formed by thinning a portion of the bridge part.

In the connecting member for construction materials according to the present invention, the coupling fittings for coupling the second end portions of the two connecting parts, which are coupled by the bridge part, with the other construction material can be arranged on opposite sides of the two connecting parts in the axial direction, and can point in opposite directions in the axial direction. Alternatively, the coupling fittings can be arranged on the side of one of the two connecting parts, which is opposite to the other connecting part, in the axial direction, and can couple the two end portions of the two connecting parts with the other construction material in the same direction in the axial direction, and at least one of the coupling fittings can draw the other connecting part of the two connecting parts toward one connecting part.

In the latter embodiment, the work for coupling the second end portions of the two connecting parts with the other construction material can be performed by using these coupling fittings from the same side in the axial direction of the locked member. Consequently, the workability can further be improved. In addition, the work for connecting two construction materials can also be performed on an internal corner portion of a building.

In the connecting member for construction materials according to the present invention, the locked member is preferably a member having projections and recesses on the surface, in order to lock the first end portion by the locked member more reliably. In this case, the first end portion of the connecting part locks on the locked member more reliably due to the abovementioned projections and recesses on the surface of the locked member.

To use a member having projections and recesses on the surface as the locked member, the locked member can be a male screw rod on the surface of which a male screw is formed, and can also be a rod-like member on which projections and recesses formed on the entire circumference are alternately continuously arranged parallel in the axial direction.

A connecting fitting for construction materials according to the present invention is a connecting fitting for construction materials, which connects two construction materials arranged with an interval therebetween, the connecting fitting including a first connecting member and a second connecting member each configured to connect the two construction materials, wherein the first connecting member includes a connecting part including a first end portion reaching a locked member arranged in one construction material of the two construction materials such that a thickness direction of the one construction material, which is perpendicular to a direction of the interval, is an axial direction, and a second end portion reaching the other construction material of the two construction materials, the second end portion is formed to have a torsion angle $\alpha$ s an inclination angle to a direction perpendicular to the axial direction of the locked member, a torsion angle as an inclination angle to a direction perpendicular to the axial direction can be generated in the first end portion when the second end portion is coupled with the other construction material and the torsion angle of the second end portion reduces or disappears, and the first end portion locks on the locked member due to the generation of the torsion angle, thereby connecting the two construction materials, and the first connecting member and the second connecting member make inclination angles to the direction of the interval, and the inclination angle of the second connecting member to the direction of the interval becomes opposite to the inclination angle of the first connecting member, thereby connecting the two construction materials.

In this connecting fitting for construction materials, the second end portion of the connecting part of the first connecting member is formed to have a torsion angle $\alpha$ s an inclination angle to a direction perpendicular to the axial direction of the locked member. Therefore, when the second end portion is coupled with the other construction material by the coupling fitting and the torsion angle of this end portion reduces or disappears, a torsion angle as an inclination angle to a direction perpendicular to the axial direction is generated in the first end portion of the connecting part. The generation of this torsion angle causes the first end portion to lock on the locked member arranged in one construction material, thereby connecting the two construction materials. Even when using this connecting fitting for construction materials, therefore, by performing the work for coupling the end portion, on the side of the other construction material, of the two end portions of the connecting part of the first connecting member, with the other construction material by using the coupling fitting, the work for connecting the two construction materials so that they are immobile in the axial direction of the locked member is spontaneously performed. This makes it possible to easily perform the work for connecting two construction materials spaced apart from each other within a short time, thereby improving the workability.

Also, in this connecting fitting for construction materials, the first connecting member connects two construction materials by forming an inclination angle to the direction of an interval between the two construction materials, and the second connecting member connects these construction materials such that the inclination angle to the direction of the interval between the two construction materials is opposite to the inclination angle of the first connecting member. Therefore, after the two construction materials are connected by the first connecting member and the second connecting member, the two construction materials can be connected as they are immobile in, e.g., the vertical direction as the direction perpendicular to the direction of the interval between the two construction materials.

Note that in this connecting member for construction materials, an insertion member different from the locked member to be inserted into the first end portion of the first connecting member can be inserted into the first end portion of the second connecting member. However, the locked member to be inserted into the first end portion of the first connecting member may also be inserted as a common insertion member into the first end portion of the second connecting member.

In this case, the use of the common insertion member can simplify the structure and reduce the cost by reducing the number of members.

A connecting structure for construction materials according to the present invention is a connecting structure for construction materials, which connects two construction materials arranged with an interval therebetween, the connecting structure including a first connecting member and a second connecting member each of which is a member for connecting the two construction materials, wherein the first connecting member includes a connecting part including a first end portion reaching a locked member arranged in one construction material of the two construction materials such that a thickness direction of the one construction material, which is perpendicular to a direction of the interval, is an axial direction, and a second end portion reaching the other construction material of the two construction materials, the second end portion is formed to have a torsion angle $\alpha$ as an inclination angle to a direction perpendicular to the axial direction of the locked member, a torsion angle as an inclination angle to a direction perpendicular to the axial direction can be generated in the first end portion when the second end portion is coupled with the other construction material and the torsion angle of the second end portion reduces or disappears, and the first end portion locks on the locked member due to the generation of the torsion angle, thereby connecting the two construction materials, and the first connecting member and the second connecting member make inclination angles to the direction of the interval, and the inclination angle of the second connecting member to the direction of the interval becomes opposite to the inclination angle of the first connecting member, thereby connecting the two construction materials.

In this connecting structure for construction materials, the second end portion of the connecting part of the first connecting member is formed to have a torsion angle $\alpha$ as an inclination angle to a direction perpendicular to the axial direction of the locked member, like the above-described connecting fitting for construction materials. Therefore, when the second end portion is coupled with the other construction material by the coupling fitting and the torsion angle of this end portion reduces or disappears, a torsion angle as an inclination angle to a direction perpendicular to the axial direction is generated in the first end portion of the connecting part. Due to the generation of this torsion angle, the first end portion locks on the locked member arranged in one construction material, and the two construction materials are connected. Even in this connecting structure for construction materials, therefore, by performing the work for coupling the second end portion of the connecting part of the first connecting member with the other construction material by using the coupling fitting, it is spontaneously possible to perform the work for connecting the two construction materials by rendering them immobile in the axial direction of the locked member. This makes it possible to easily perform the work for connecting two construction materials spaced apart from each other within a short time, thereby improving the workability.

In addition, in this connecting structure for construction materials, the first and second connecting members make inclination angles to the direction of the interval, and the two construction materials are connected such that the inclination angle of the second connecting member with respect to the direction of the interval is opposite to the inclination angle of the first connecting member. Accordingly, after the two construction materials are connected by the first and second connecting members, the two construction materials can be connected as they are rendered immobile in, e.g., the vertical direction as a direction perpendicular to the direction of the interval between these construction materials.

A connecting method for construction materials according to the present invention is a connecting method for construction materials, which connects two construction materials arranged with an interval therebetween, wherein the method connects the two construction materials by using a first connecting member and a second connecting member each of which is a member for connecting the two construction materials, the first connecting member includes a connecting part including a first end portion reaching a locked member arranged in one construction material of the two construction materials such that a thickness direction of the one construction material, which is perpendicular to a direction of the interval, is an axial direction, and a second end portion reaching the other construction material of the two construction materials, the second end portion is formed to have a torsion angle $\alpha$ as an inclination angle to a direction perpendicular to the axial direction of the locked member, a torsion angle as an inclination angle to a direction perpendicular to the axial direction can be generated in the first end portion when the second end portion is coupled with the other construction material and the torsion angle of the second end portion reduces or disappears, and the first end portion locks on the locked member due to the generation of the torsion angle, thereby connecting the two construction materials, the first connecting member and the second connecting member make inclination angles to the direction of the interval, and the inclination angle of the second connecting member to the direction of the interval becomes opposite to the inclination angle of the first connecting member, thereby connecting the two construction materials, and the method includes a first working step of inserting the first connecting member and the second connecting member between the two construction materials such that the first connecting member and the second connecting member are arranged parallel or almost parallel to each other in a direction perpendicular to the direction of the interval and to the thickness direction of one of the two construction materials, a second working step of making the inclination angles of the first connecting member and the second connecting member to the direction of the interval opposite to each other, after the first working step, and a third working step of connecting the two construction materials by the first connecting member and the second connecting member, after the second working step.

In this connecting method for construction materials, the second end portion of the connecting part of the first connecting member is formed to have a torsion angle $\alpha$ as an inclination angle to a direction perpendicular to the axial direction of the locked member, like the above-described connecting fitting for construction materials and connecting structure for construction materials. Therefore, when the second end portion is coupled with the other construction material by the coupling fitting and the torsion angle of this end portion reduces or disappears, a torsion angle as an inclination angle to a direction perpendicular to the axial direction is generated in the first end portion of the connecting part. Due to the generation of this torsion angle, the first end portion locks on the locked member arranged in one construction material, and the two construction materials are connected. Even in this connecting fitting for construction materials, therefore, by performing the work for coupling the second end portion of the connecting part of the first connecting member with the other construction material by using the coupling fitting, it is possible to spontaneously perform the work for connecting the two construction materials by rendering them immobile in the axial direction of the locked member. This makes it possible to easily perform the work for connecting two construction materials spaced apart from each other within a short time, thereby improving the workability.

In addition, in this connecting method for construction materials, the first and second connecting members make inclination angles to the direction of the interval, and the two construction materials are connected such that the inclination angle of the second connecting member with respect to the direction of the interval is opposite to the inclination angle of the first connecting member. Accordingly, after the two construction materials are connected by the first and second connecting members, the two construction materials can be connected as they are rendered immobile in, e.g., the vertical direction as a direction perpendicular to the direction of the interval between these construction materials.

Furthermore, in this connecting method for construction materials, when inserting the first and second connecting members between the two construction materials in the first working step, the first and second connecting members are made parallel or almost parallel to each other as they are arranged in the direction perpendicular to the direction of the interval and to the thickness direction of one of the two construction materials. Therefore, the work for inserting the first and second connecting members between two construction materials can effectively be performed even when the interval between the first and second connecting members is small.

Two construction materials to be connected by the connecting member for construction materials, the connecting fitting therefor, the connecting structure therefor, and the connecting method therefor according to the present invention explained above can be arbitrary construction materials. One example of these construction materials includes a skeleton-side construction material such as a wall, and an opening frame arranged to oppose this construction material in the horizontal direction. This opening frame can be any of a door frame for a hinged door apparatus, an opening frame for a sliding door apparatus, and an opening frame for a passing opening to be formed in a wall. Also, one of the two construction materials can be a door case for accommodating a fire door that is normally opened from a door frame. In addition, the connecting member for construction materials, the connecting fitting therefor, the connecting structure therefor, and the connecting method therefor according to the present invention can also be used to connect two construction materials such as pillars including a middle pillar of a building, beams, crossbars, and face plates, that is, the present invention is applicable to arbitrary construction materials.

Furthermore, the connecting member for construction materials, the connecting fitting therefor, the connecting structure therefor, and the connecting method therefor according to the present invention are applicable to construction materials to be newly formed in a structure such as a building, and are also applicable to construction materials to be repaired.

Effect of the Invention

The present invention achieves the effect of easily performing the work for connecting two construction materials spaced apart from each other within a short time, thereby improving the workability.

BEST MODE FOR CARRYING OUT THE INVENTION

Figure 1:
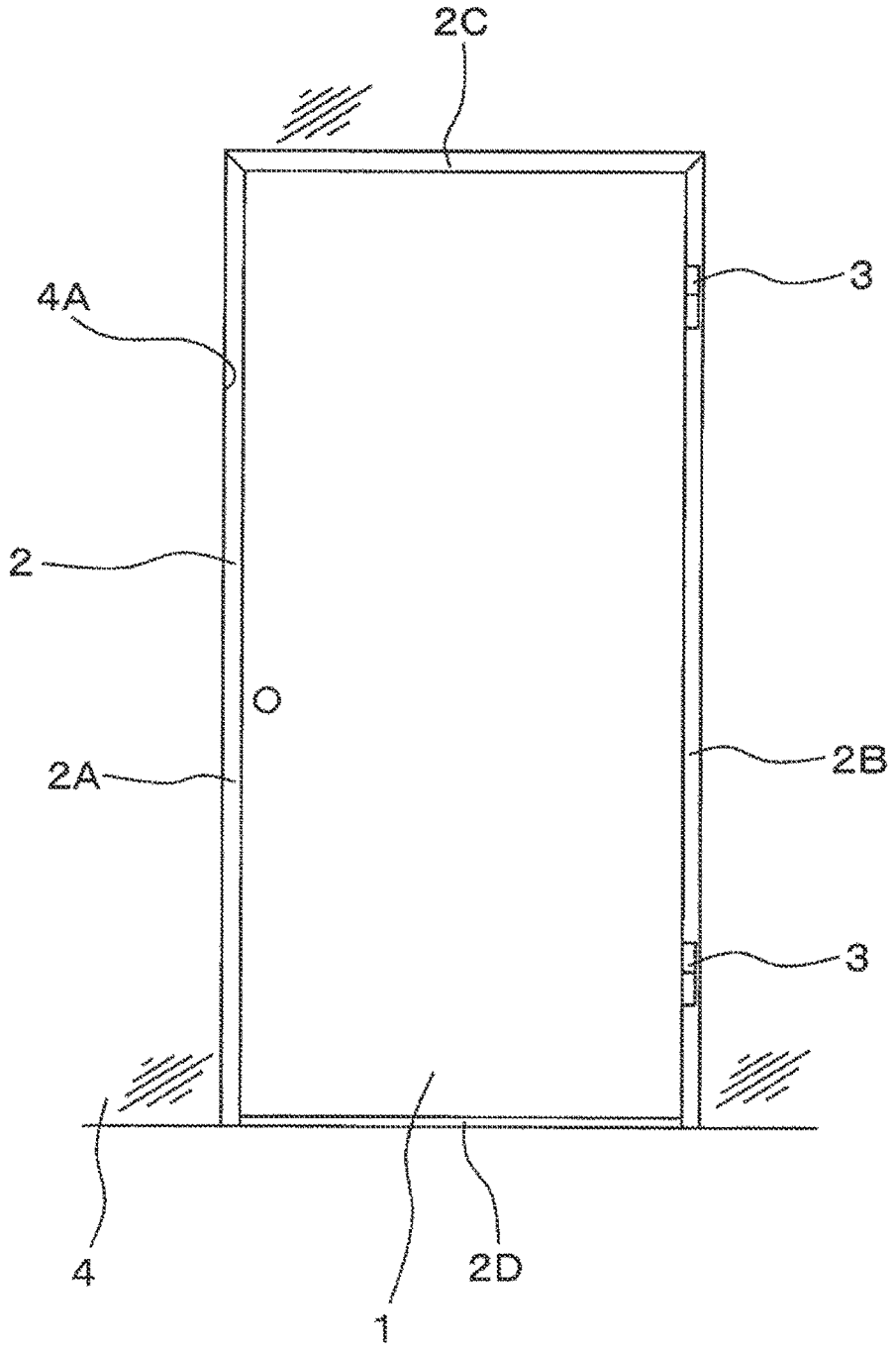
FIG. 1 is a whole front view of a hinged door apparatus to which a connecting fitting for construction materials according to an embodiment of the present invention is applied.
Figure 2:
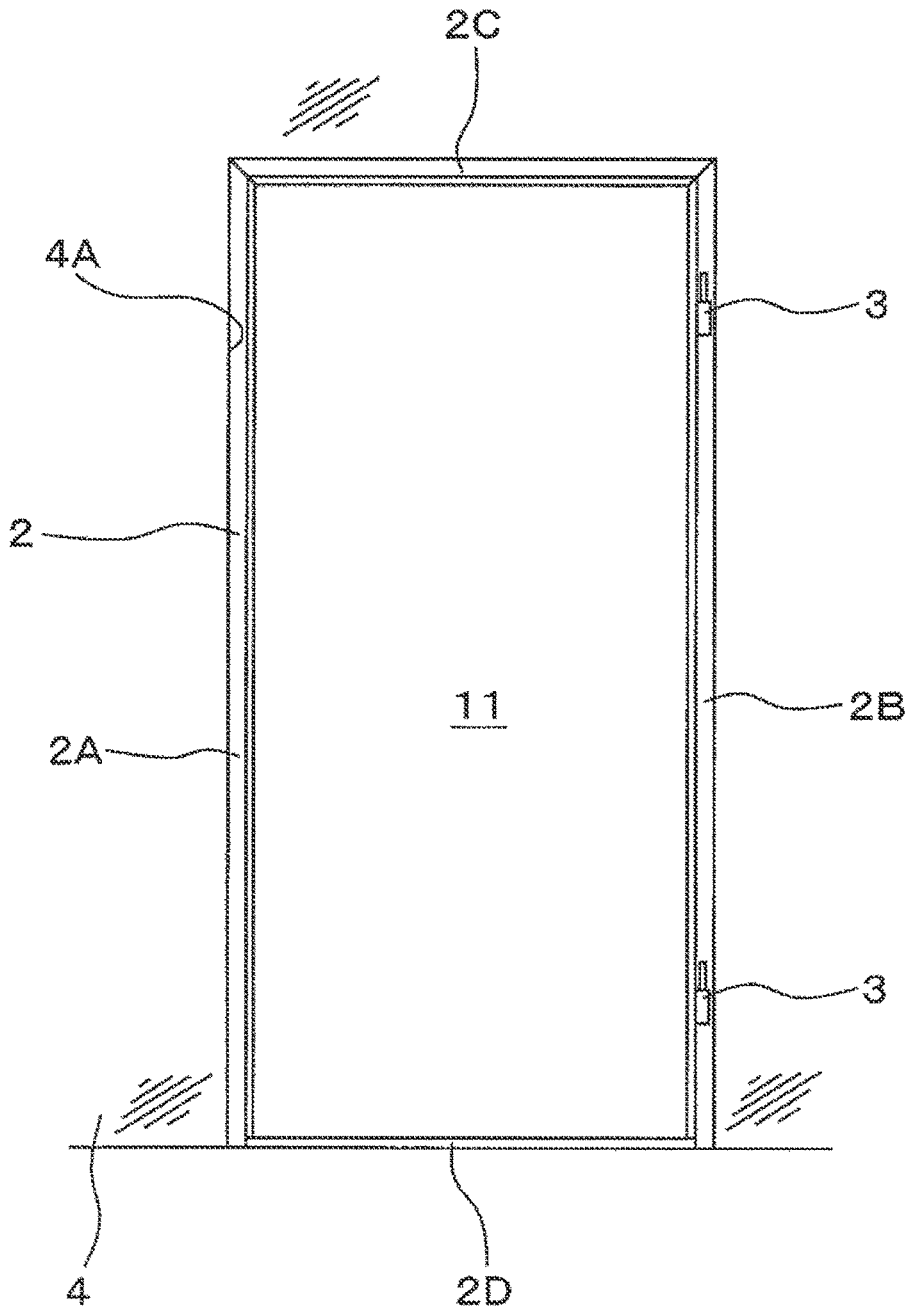
FIG. 2 is a whole front view showing a door frame as a construction material on the side of the hinged door apparatus.

A mode for carrying out the present invention will be explained below with reference to the accompanying drawings. FIG. 1 shows a whole front view of a hinged door apparatus. In this hinged door apparatus, a hinged door 1 is attached to a door frame 2 so as to be pivotal around hinges 3, and the door frame 2 is arranged inside an opening 4A formed in a wall 4 as a building skeleton. FIG. 2 shows the door frame 2 before the hinged door 1 is attached. As shown in FIG. 2, the door frame 2 is an opening frame as a doorway 11 the inside of which is opened and closed by the hinged door 1. Since the door frame 2 of this embodiment is a four-side frame, the door frame 2 includes left and right side frame members 2A and 2B, an upper frame member 2C, and a lower frame member 2D as a doorsill member. The frame members 2A, 2B, 2C, and 2D are welded in a factory beforehand, and transported to the construction site of a structure such as a building in which the hinged door apparatus is installed.

Note that the door frame 2 may also be a three-side frame having no lower frame member 2D.

Figure 3:
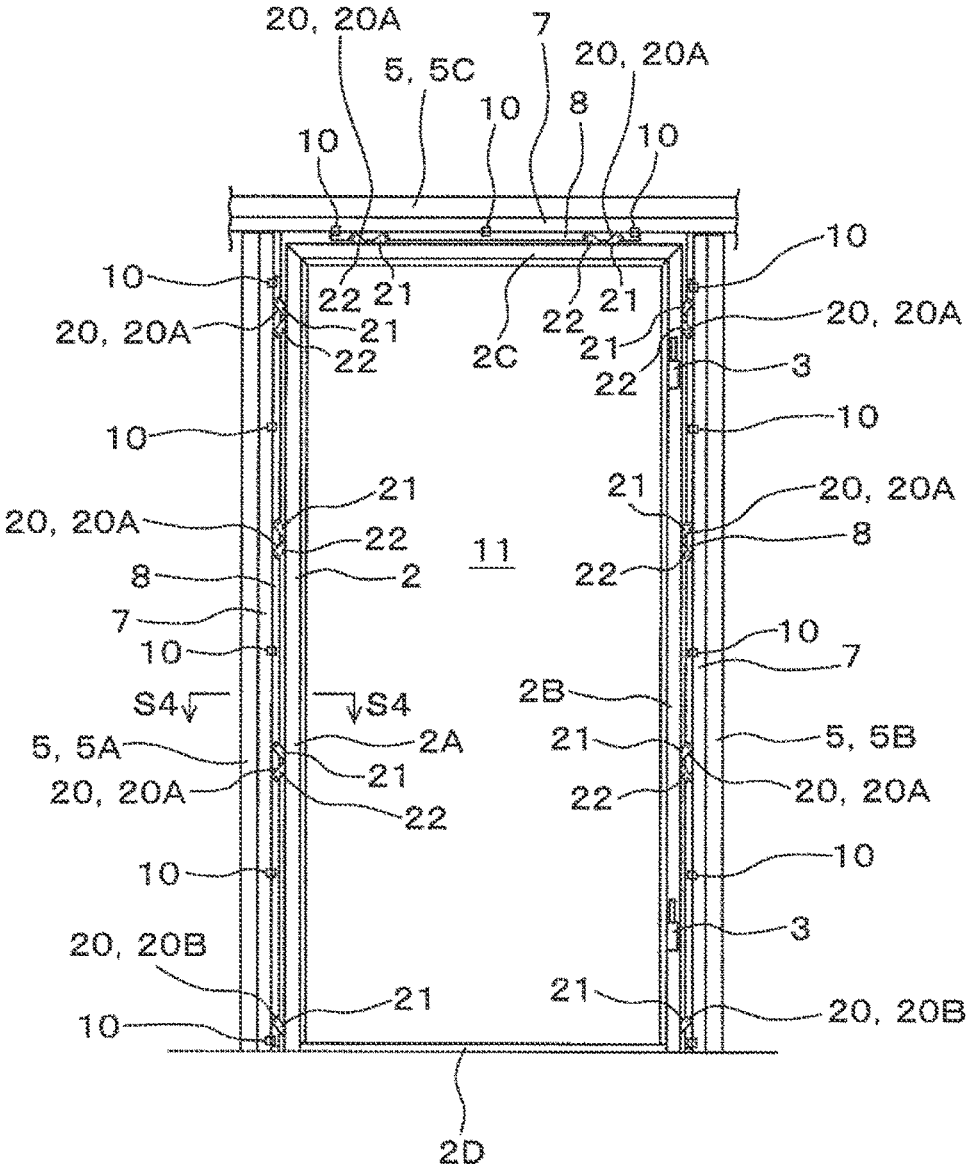
FIG. 3 is a whole front view showing a structure in which first and second connecting fittings connect a door frame and a reinforcing member as a skeleton-side construction material via an auxiliary member attached to the reinforcing member.
Figure 4:
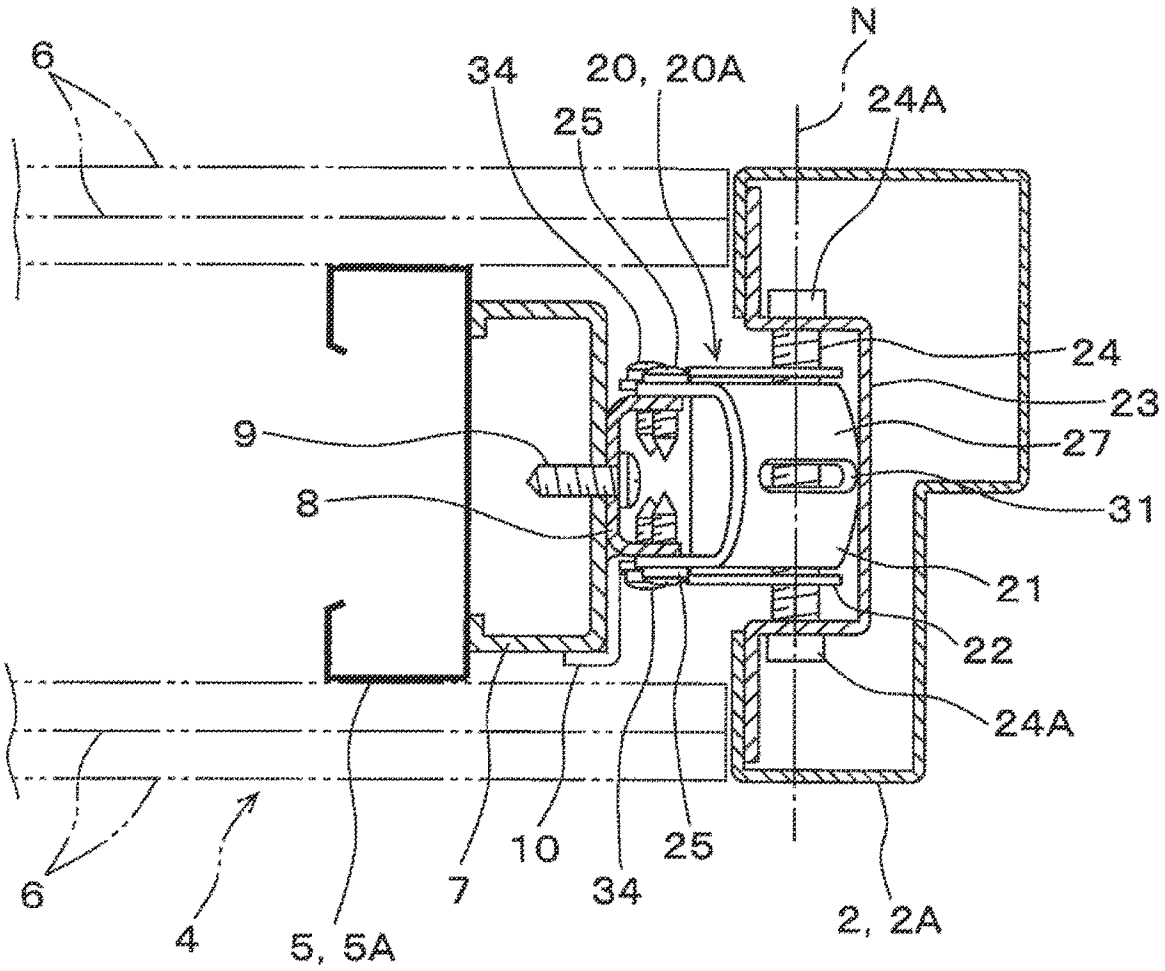
FIG. 4 is a sectional view taken along a line S4-S4 shown in FIG. 3.

FIG. 3 shows a state in which the door frame 2 is arranged in the wall 4 shown in FIGS. 1 and 2. FIG. 4 is a sectional view taken along a line S4-S4 shown in FIG. 3. As shown in FIG. 4, the wall 4 shown in FIGS. 1 and 2 is a building skeleton formed by fixing face plates 6 such as plaster boards on both the front and rear surfaces of core members 5. The door frame 2 is arranged inside the opening 4A shown in FIGS. 1 and 2 formed in the wall 4. Of a large number of core members 5 formed inside the wall 4, FIG. 3 shows core members 5A and 5B arranged in portions opposing, in the horizontal direction, the left and right side frame members 2A and 2B of the door frame 2, and a core member 5C arranged in a portion opposing the upper frame member 2C of the door frame 2 in the vertical direction.

Before the work for arranging the door frame 2 inside the opening 4A of the wall 4, reinforcing members 7 shown in FIGS. 3 and 4 are coupled with the core members 5A, 5B, and 5C in advance. Also, an auxiliary member 8 is attached to each reinforcing member 7 by a fixing fitting 9 shown in FIG. 4. A crank-shaped positioning member 10 is coupled with each auxiliary member 8. After each positioning member 10 is brought into contact with one of the two surfaces of the reinforcing member 7 in the thickness direction of the door frame 2 (the thickness direction of the hinged door 1 and the wall 4), the auxiliary member 8 is attached to the reinforcing member 7 by the fixing fitting 9. Consequently, each auxiliary member 8 is set in a predetermined position in the thickness direction of the door frame 2 and attached to the reinforcing member 7.

In the above explanation, the core member 5, the reinforcing member 7, and the auxiliary member 8 are members of the wall 4 as a building skeleton, so the core member 5, the reinforcing member 7, and the auxiliary member 8 are skeleton-side construction materials. On the other hand, the hinged door 1 and the door frame 2 are members of the hinged door apparatus to be installed in the wall 4, so the hinged door 1 and the door frame 2 are hinged door apparatus-side construction materials.

Figure 5:
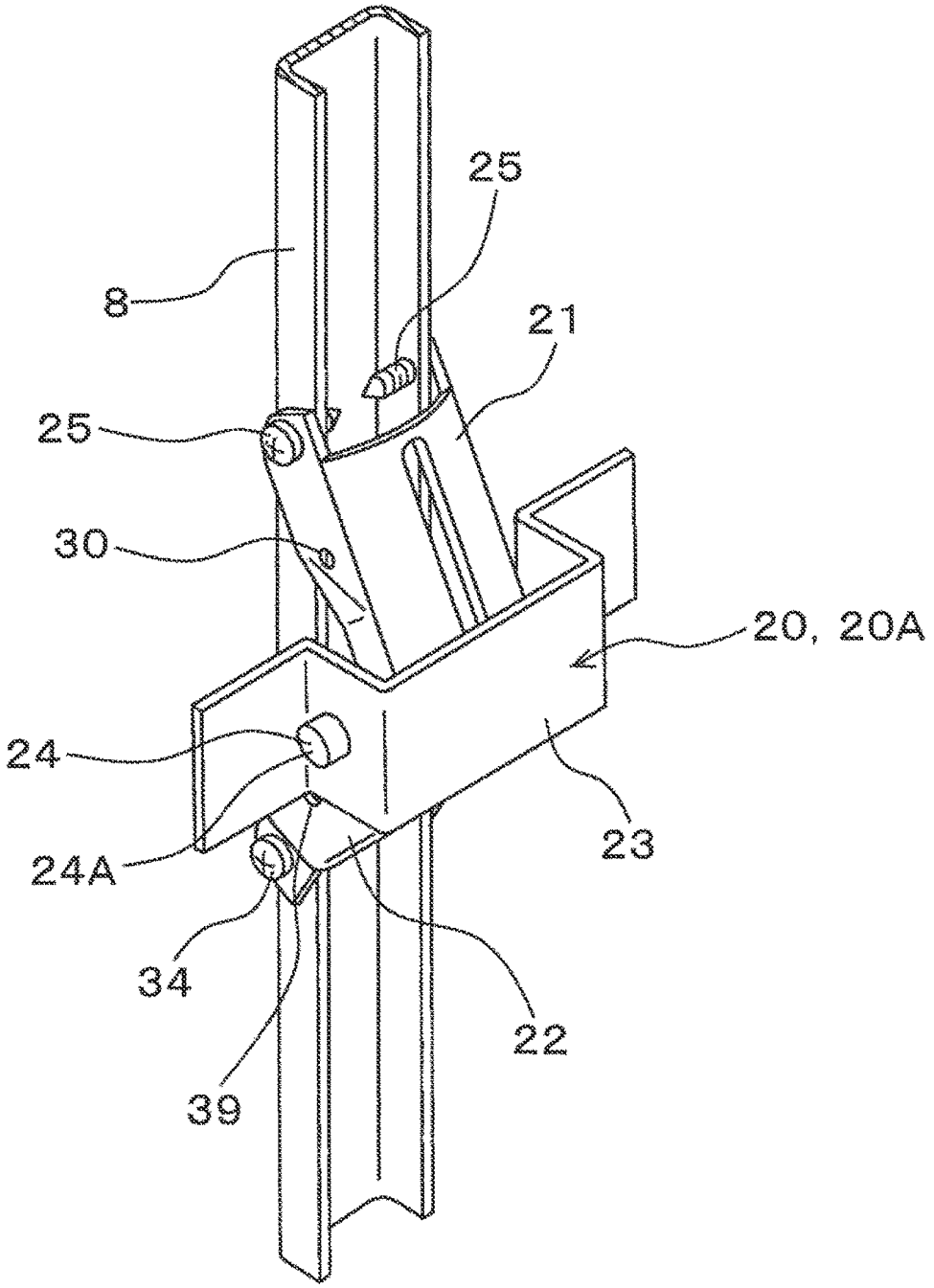
FIG. 5 is a perspective view showing the whole first connecting fitting shown in FIG. 3 by including the auxiliary member shown in FIGS. 3 and 4.
Figure 6:
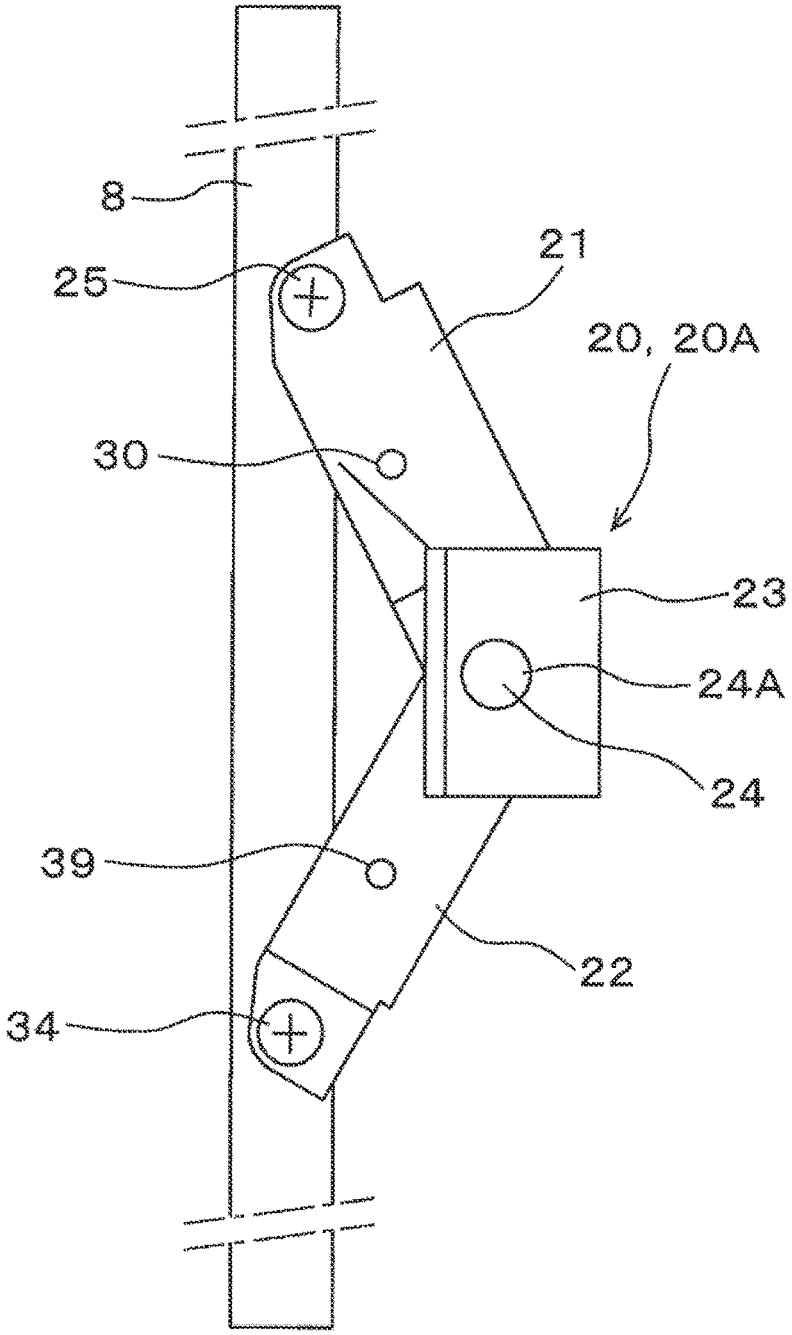
FIG. 6 is a front view of FIG. 5.

FIG. 3 shows a state in which after the work for arranging the door frame 2 inside the opening 4A of the wall 4 is performed, the door frame 2 is connected to the reinforcing member 7 via the auxiliary member 8 by using a connecting fitting 20. A plurality of connecting fittings 20 are formed for each of the left and right side frame members 2A and 2B and the upper frame member 2C of the door frame 2, and connect the door frame 2 to the reinforcing members 7 via the auxiliary members 8. As the connecting fittings 20, a plurality of first connecting fittings 20A and two second connecting fittings 20B are used. The first connecting fitting 20A includes first and second connecting members 21 and 22, whereas the second connecting fitting 20B includes the first connecting member 21 but does not include the second connecting member 22. The plurality of first connecting fittings 20A have the same shape and the same structure. Therefore, FIGS. 5 and 6 illustrate, as a typical example of the plurality of first connecting fittings 20A shown in FIG. 3, the first connecting fitting 20A that is arranged on the side frame member 2A of the door frame 2 shown in FIG. 4 and connects the side fame member 2A to the auxiliary member 8 attached to the reinforcing member 7 coupled with the core member 5A described earlier. FIGS. 5 and 6 do not show the side frame member 2A.

Note that the two second connecting fittings 20B shown in FIG. 3 also have the same shape and the same structure. As shown in FIG. 3, the second connecting fittings 20B are arranged below the plurality of first connecting fittings 20A vertically arranged on each of the left and right side frame members 2A and 2B.

FIG. 5 shows a perspective view of the first connecting fitting 20A by including the auxiliary member 8. FIG. 6 is a front view of FIG. 5. As is also shown in FIG. 4, the first connecting fitting 20A includes a bearing member 23 formed into the shape of a hat, a central shaft 24 supported by the bearing member 23, and the first and second connecting members 21 and 22 described above. The thickness direction of the door frame 2 is an axial direction N of the central shaft 24, and the two end portions in the axial direction N function as retaining portions 24A and retain the central shaft 24. As shown in FIG. 4, the central shaft 24 is inserted, as an insertion member common to the first and second connecting members 21 and 22, through the end portions, on the side of the door frame 2, of the first and second connecting members 21 and 22. The first and second connecting members 21 and 22 can freely pivot around the central shaft 24. Also, the end portion, on the side of the wall 4, of the first connecting member 21 is coupled with the auxiliary member 8 by coupling fittings 25 as self-drill screws. Likewise, the end portion, on the side of wall 4, of the second connecting member 22 is coupled with the auxiliary member 8 by coupling fittings 34 as self-drill screws.

FIGS. 7A, 7B, 7C, and 7D depict the first connecting member 21. FIGS. 7A, 7B, 7C, and 7D are respectively a plan view, a side view, a bottom view, and a rear view of the first connecting member 21. The first connecting member 21 is a product obtained by punching and bending a metal plate. The first connecting member 21 includes two connecting parts 26 opposing each other. The two connecting parts 26 are separated from each other in the axial direction N of the central shaft 24, and coupled with each other by a bridge part 27 for which the axial direction N of the central shaft 24 is the widthwise dimension. The bridge part 27 is bridged between the end portions of the two connecting parts 26, on the side of the thickness direction of the whole first connecting member 21 perpendicular to the axial direction N of the central shaft 24. Also, assuming that a direction perpendicular to the axial direction N of the central shaft 24 and perpendicular to the thickness direction of the whole first connecting member 21 is the longitudinal direction of each connecting part 26, the dimension of each connecting part 26 in the longitudinal direction is a dimension by which two end portions 26A and 26B of the connecting part 26 in the longitudinal direction reach the door frame 2 and the auxiliary member 8 as the skeleton of the wall 4.

Figure 7A:
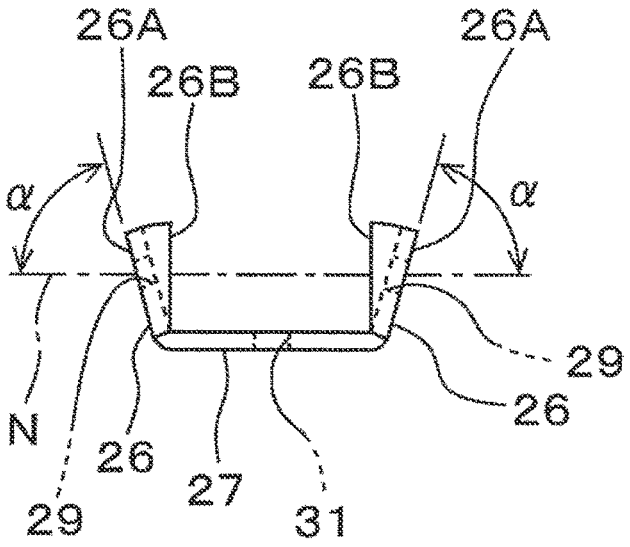
FIG. 7A is a plan view showing a first connecting member as a constituting member of the first and second connecting fittings.
Figure 7B:
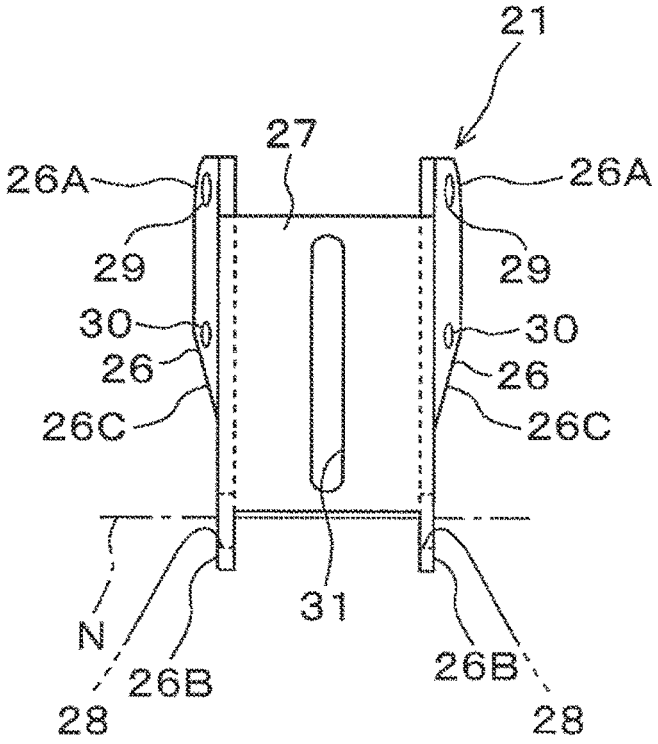
FIG. 7B is a side view showing the first connecting member as a constituting member of the first and second connecting fittings.
Figure 7C:
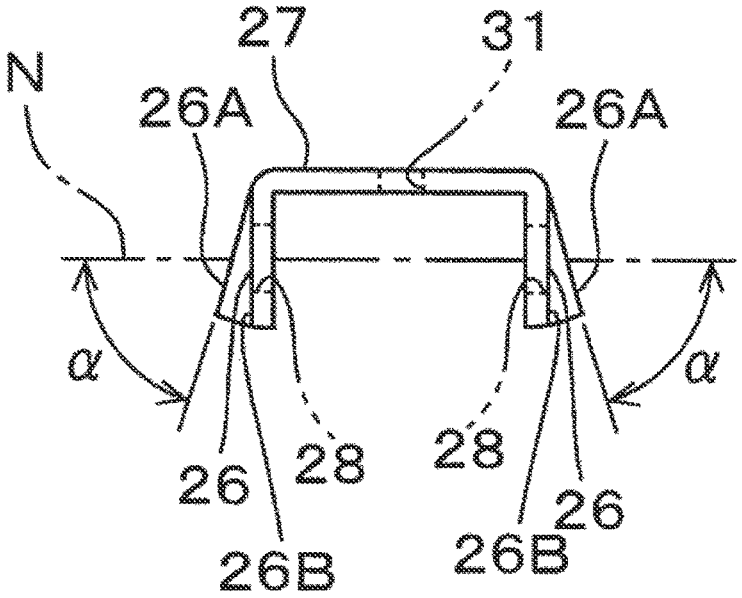
FIG. 7C is a bottom view showing the first connecting member as a constituting member of the first and second connecting fittings.
Figure 7D:
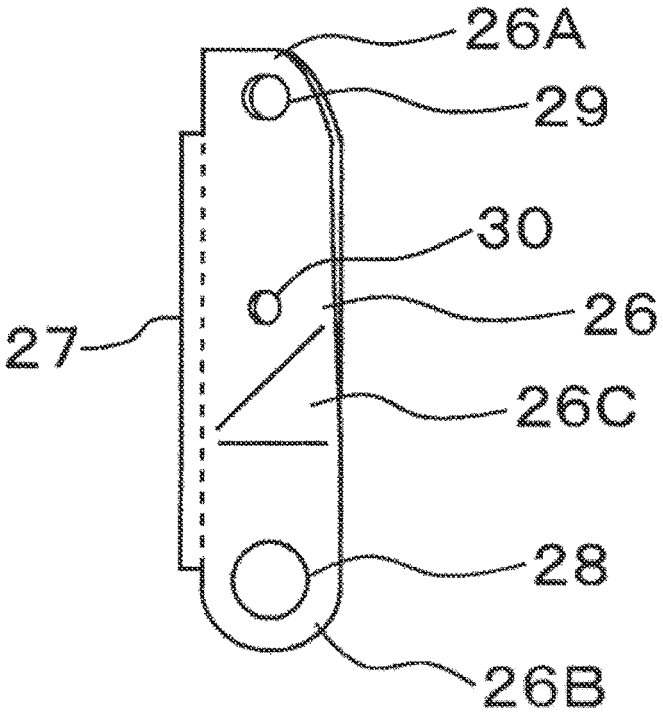
FIG. 7D is a rear view showing the first connecting member as a constituting member of the first and second connecting fittings.

As shown in FIGS. 7A and 7C, the end portion 26A, on the side of the auxiliary member 8, of the two end portions 26A and 26B of each connecting part 26 in the longitudinal direction has a torsion angle 90°-α as an angle inclining to the outside of the first connecting member 21 with respect to a direction perpendicular to the axial direction N of the central shaft 24. The torsion angles 90°-α of the two connecting parts 26 are torsion angles in directions opposite to each other. On the other hand, as shown in FIGS. 7A and 7C, the end portion 26B on the side of the door frame 2 has no such torsion angle α s described above. A portion between the end portions 26A and 26B is an intermediate portion 26C for gradually eliminating the torsion angle 90°-α. The end portion 26B on the side of the door frame 2 has a first hole 28 having a large diameter, as an insertion portion for inserting the central shaft 24, and the end portion 26A on the side of the auxiliary member 8 has a small-diameter second hole 29 for inserting the coupling fitting 25 shown in FIG. 4. The connecting parts 26 also have third holes 30 for inserting coupling fittings 50 and 51 to be described later with reference to FIGS. 19 and 20, within the range in which the above-described torsion angle 90°-α exists.

Furthermore, the bridge part 27 has an elongated hole 31. The elongated hole 31 is elongated in the longitudinal direction of the connecting part 26, and functions as a strength decreasing portion formed in the bridge part 27 in order to decrease the strength of the bridge part 27.

As described above, the first connecting member 21 is formed by the two connecting parts 26 and the bridge part 27 bridged between the connecting parts 26, and the section perpendicular to the longitudinal direction is an almost U-shaped section. However, the end portions 26A, on the side of the auxiliary member 8, of the two connecting parts 26 open to the outside of the first connecting member 21 due to the torsion angles 90°-α described above. In other words, the end portions 26A form an inverted V-shape that opens outward in the axial direction N of the central shaft 24.

Figure 8A:
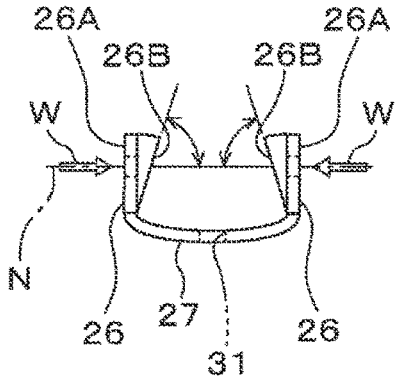
FIG. 8A is a plan view showing the first connecting member when loads act.
Figure 8B:
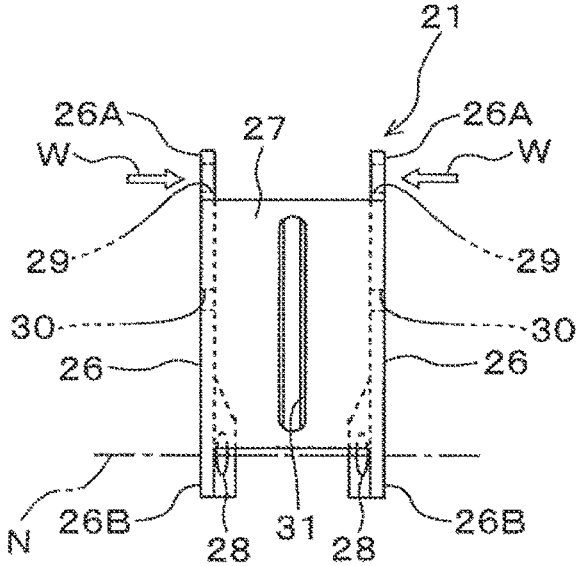
FIG. 8B is a side view showing the first connecting member when the loads act.
Figure 8C:
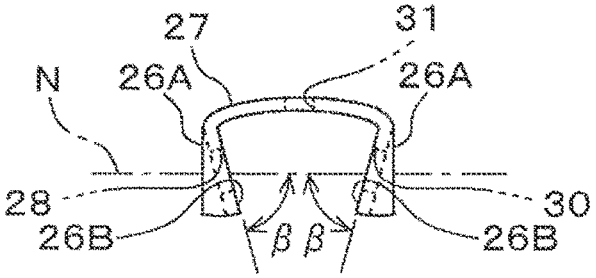
FIG. 8C is a bottom view showing the first connecting member when the loads act.

FIGS. 8A, 8B, and 8C depict a state in which loads W in directions opposite to each other in the axial direction N of the central shaft 24 act on the end portions 26A, on the side of the auxiliary member 8, of the connecting parts 26. A state like this occurs when the coupling fitting 25 shown in FIG. 4 couples the end portions 26A, on the side of the auxiliary member 8, of the connecting parts 26, with the auxiliary member 8. When the loads W as described above act on the end portions 26A on the side of the auxiliary member 8, the torsion angles 90°-α shown in FIGS. 7A and 7C of the end portions 26A on the side of the auxiliary member 8 reduce or disappear, and the influence of the loads W deforms, e.g., curves the bridge part 27 in a direction projecting to the outside of the first connecting member 21, in the thickness direction of the bridge part 27 (the thickness direction of the whole first connecting member 21). The influence of the loads W also generates torsion angles 90°-β as angles inclining to the inside of the first connecting member 21 with respect to a direction perpendicular to the axial direction N of the central shaft 24, on the end portions 26B on the side of the door frame 2, which are connected to the end portions 26A on the side of the auxiliary member 8 via the intermediate portion 26C. The torsion angles 90°-β are torsion angles in directions opposite to each other with respect to the end portions 26B on the side of the door frame 2.

In the whole first connecting member 21, therefore, the shape formed by the end portions 26B, on the side of the door frame 2, of the two connecting parts 26 is a V-shape that closes to the inside of the first connecting member 21 due to the torsion angles 90°-β.

Note that the elongated hole 31 is formed in the bridge part 27 and decreases the strength of the bridge part 27, so the bridge part 27 is easily deformed, e.g., curved as described above, due to the loads W. Accordingly, the reduction or elimination of the torsion angles 90°-α of the end portions 26A on the side of the auxiliary member 8 and the generation of the torsion angles 90°-β of the end portions 26B on the side of the door frame 2 occur more reliably.

Figure 9A:
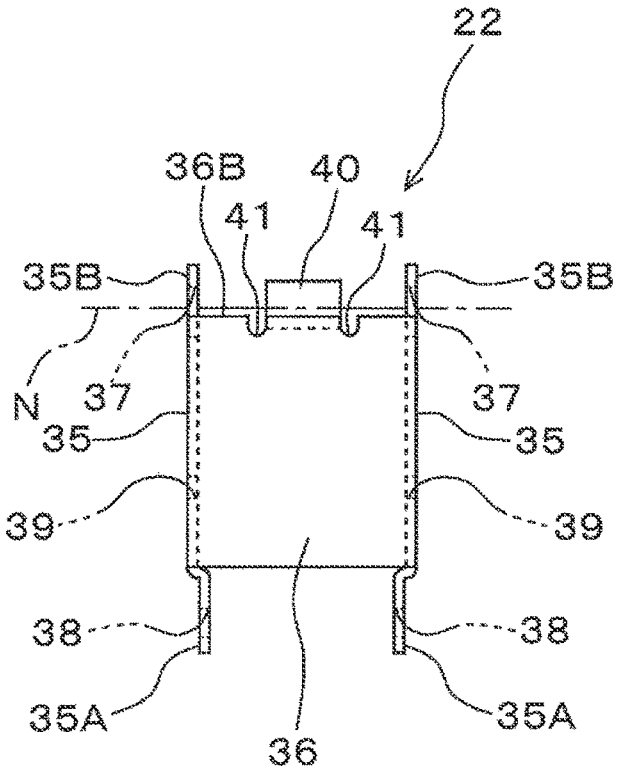
FIG. 9A is a side view showing a second connecting member as a constituting member of the first connecting fitting.
Figure 9B:
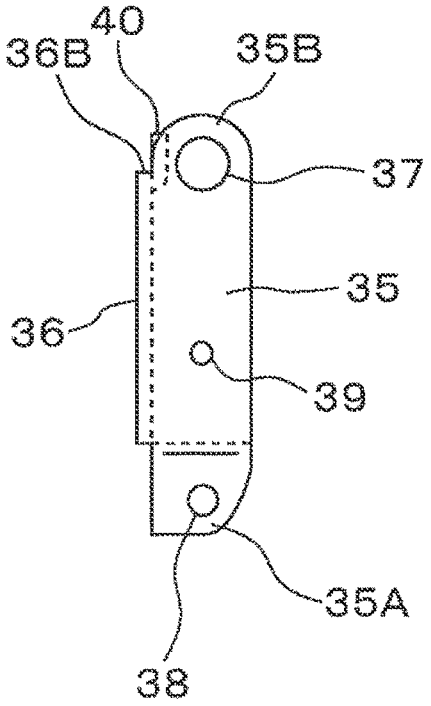
FIG. 9B is a rear view showing the second connecting member as a constituting member of the first connecting fitting.

FIGS. 9A and 9B show the second connecting member 22. FIGS. 9A and 9B are respectively a side view and a rear view of the second connecting member 22. Like the first connecting member 21, the second connecting member 22 is a product obtained by punching and bending a metal plate. The second connecting member 22 also includes two connecting parts 35 opposing each other. The two connecting parts 35 are separated from each other in the axial direction N of the central shaft 24, and coupled with each other by a bridge part 36 for which the axial direction N of the central shaft 24 is the widthwise dimension. The bridge part 36 is bridged between the end portions of the two connecting parts 35, on the side of the thickness direction of the whole second connecting member 22 perpendicular to the axial direction N of the central shaft 24. Also, assuming that a direction perpendicular to the axial direction N of the central shaft 24 and perpendicular to the thickness direction of the whole second connecting member 22 is the longitudinal direction of each connecting part 35, the dimension of each connecting part 35 in the longitudinal direction is a dimension by which two end portions 35A and 35B of the connecting part 35 in the longitudinal direction reach the door frame 2 and the auxiliary member 8 as the skeleton of the wall 4.

Also, of the two end portions 35A and 35B in the longitudinal direction of each connecting part 35, the end portion 35A on the side of the auxiliary member 8 slightly bends toward the inside of the second connecting member 22 with respect to the end portion 35B on the side of the door frame 2. Of the end portions 35A and 35B, the end portion 35B on the side of the door frame 2 has a first hole 37 having a large diameter, as an insertion portion for inserting the central shaft 24, and the end portion 35A on the side of the auxiliary member 8 has a second hole 38 having a small diameter, as an insertion portion for inserting the coupling fitting 34 shown in FIG. 4. In addition, the connecting parts 35 have third holes 39 for inserting the coupling fittings 50 and 51 to be described later with reference to FIGS. 19 and 20.

Furthermore, the end portion 36B, on the side of the door frame 2, of the bridge part 36 has a projecting piece 40 that projects toward the central shaft 24, in other words, projects toward the first connecting member 21. The end portion 36B of the bridge part 36 has notches 41 in portions close to the projecting piece 40. In the end portion 36B of this embodiment, two notches 41 are formed on the two sides of the projecting piece 40. Note that as shown in FIG. 9B, the projecting piece 40 of this embodiment is so formed as to slightly bend from the bridge part 36 to the inside of the second connecting member 22 in the thickness direction.

The projecting piece 40 formed in the second connecting member 22 as described above can be bent in the thickness direction of the whole second connecting member 22 if a load acts on the projecting piece 40 in this thickness direction. The two notches 41 of the end portion 36B of the bridge part 36, which are formed on the two sides of the projecting piece 40, function as strength decreasing portions for decreasing the strength of the proximal end portion of the projecting piece 40 in the bridge part 27. Therefore, the projecting piece 40 can easily be bent even if the above-mentioned load acting on the projecting piece 40 is small.

Figure 10:
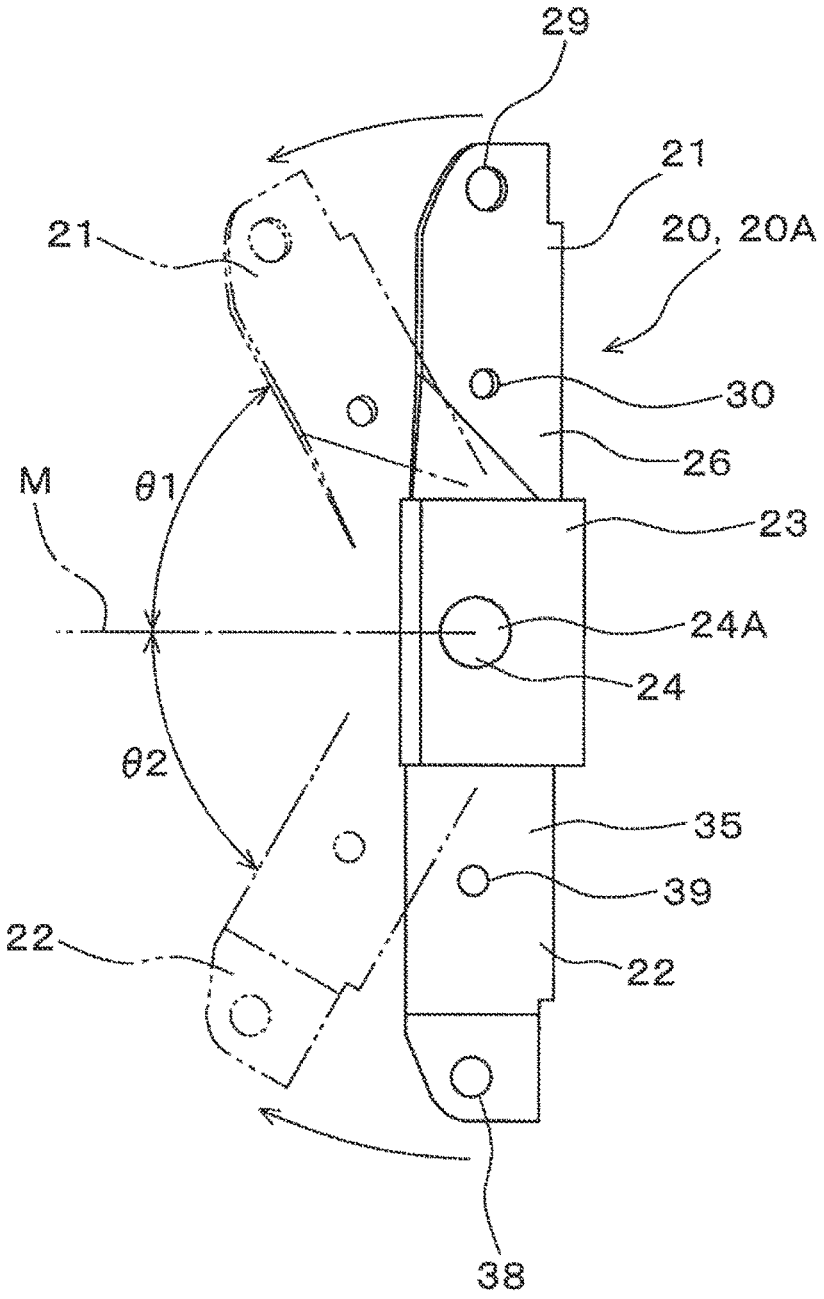
FIG. 10 is a front view showing, by the solid lines, a state in which the first and second connecting members of the first connecting fitting shown in FIGS. 5 and 6 are parallel or almost parallel to each other.
Figure 11:
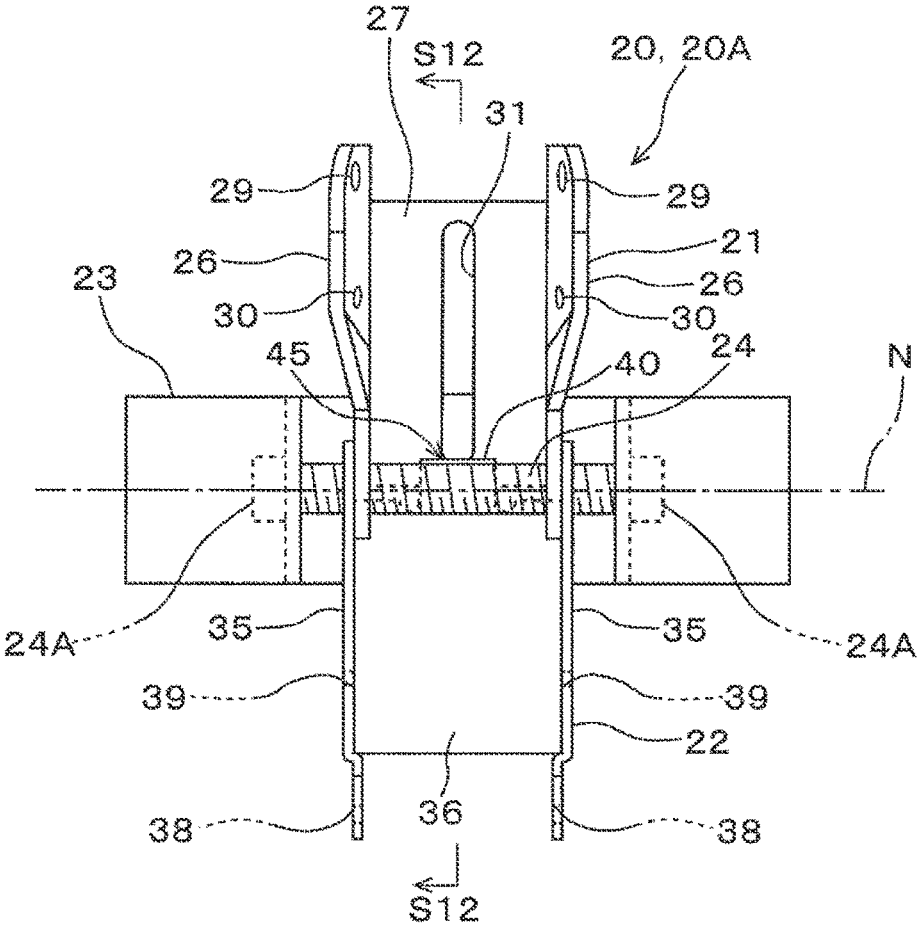
FIG. 11 is a side view showing the first connecting fitting when the first and second connecting members are in the state indicated by the solid lines in FIG. 10.

In a factory for manufacturing the door frame 2, the first connecting fitting 20A including the first connecting member 21, the second connecting member 22, the bearing member 23, and the central shaft 24 explained above is assembled into a structure shown in FIG. 10 (a front view of the first connecting fitting 20A) and FIG. 11 (a side view of the first connecting fitting 20A). This assembling is performed by, e.g., inserting the central shaft 24 as a common insertion member into the first holes 28 formed in the connecting parts 26 of the first connecting member 21 and the first holes 37 formed in the connecting parts 35 of the second connecting member 22, further inserting the central shaft 24 into the hat-shaped bearing member 23, and performing processing that forms the retaining portions 24A on the two end portions of the central shaft 24 in order to prevent removal from the bearing member 23.

Note that the central shaft 24 according to this embodiment is a male screw rod on the surface of which many projections and recesses are alternately formed in the axial direction by thread ridges and grooves.

Figure 12:
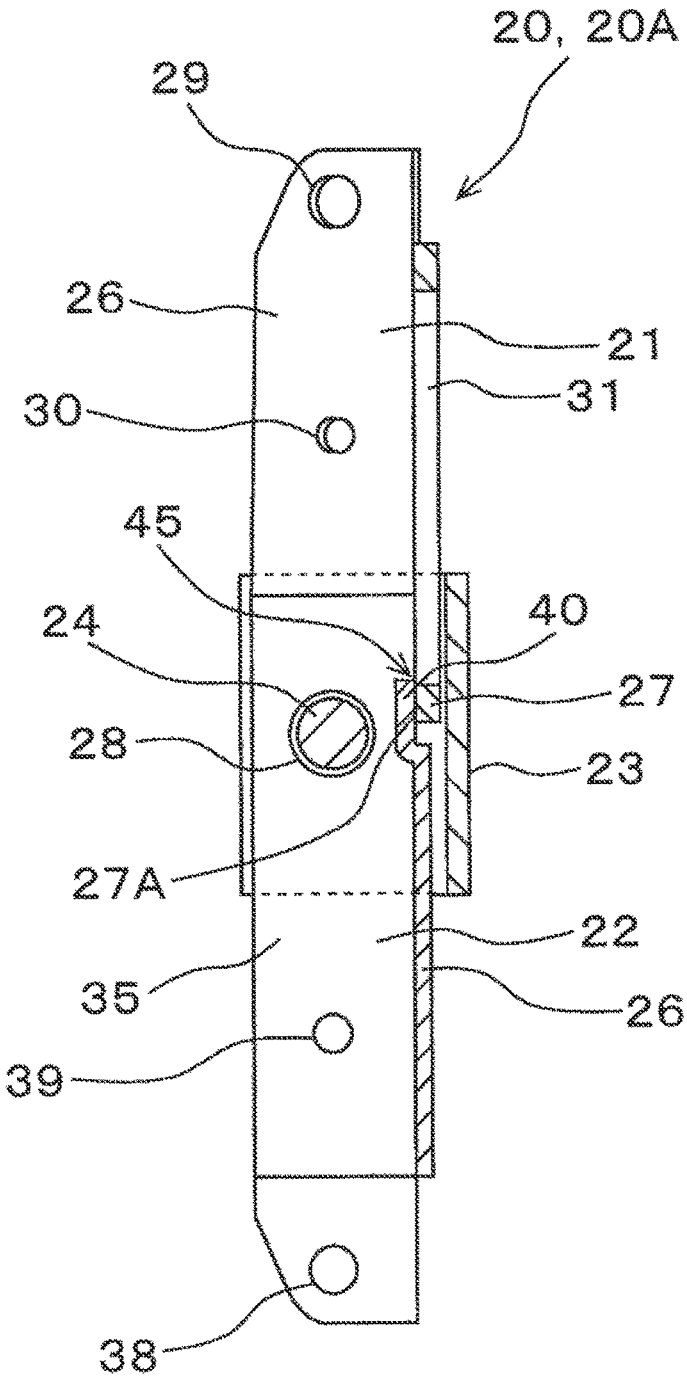
FIG. 12 is a sectional view taken along a line S12-S12 shown in FIG. 11.

FIG. 12 is a sectional view taken along a line S12-S12 shown in FIG. 11. FIG. 12 shows the sectional view of the first connecting fitting 20A assembled by the first connecting member 21, the second connecting member 22, the bearing member 23, and the central shaft 24 as described above. In the first connecting fitting 20A assembled in a factory, the projecting piece 40 formed in the second connecting member 22 is in contact with a rear surface 27A of the bridge part 27 formed in the first connecting member 21. Therefore, the first and second connecting members 21 and 22 for which the central shaft 24 is a common insertion member is connected by the central shaft 24. Also, the first and second connecting members 21 and 22 are parallel or almost parallel to each other in a direction perpendicular to the axial direction N of the central shaft 24.

Accordingly, the projecting piece 40 forms a parallelizing means 45 that aligns the first and second connecting members 21 and 22 in the direction perpendicular to the axial direction N of the central shaft 24 and makes first and second connecting members 21 and 22 parallel or almost parallel to each other. Also, as will be described later, when the first connecting fitting 20A is inserted into the gap between the door frame 2 shown in FIG. 3 and the auxiliary member 8 as a construction material of the wall, the parallelizing function of the parallelizing means 45 can align the first and second connecting members 21 and 22 in a direction (the vertical direction for the first connecting fitting 20A arranged in the side frame members 2A and 2B of the door frame 2, and the horizontal direction for the first connecting fitting 20A arranged in the upper frame member 2C of the door frame 2) perpendicular to the direction of the interval between the door frame 2 and the auxiliary member 8, and to the thickness direction of the door frame 2 (that is also the thickness direction of the wall 4 shown in FIGS. 1 and 2), thereby making the first and second connecting members 21 and 22 parallel or almost parallel to each other.

As shown in FIG. 4, in the factory having manufactured the door frame 2, the first connecting fitting 20A described above is attached to the door frame 2 by fixing the bearing member 23 to the left and right side frame members 2A and 2B and the upper frame member 2C of the door frame 2 by welding or the like. The second connecting fitting 20B shown in FIG. 3 includes the first connecting member 21, the bearing member 23, and the central shaft 24. Accordingly, the second connecting fitting 20B has a structure obtained by removing the second connecting member 22 from the first connecting fitting 20A. The second connecting fitting 20B as described above is also attached to the door frame 2 in the factory by fixing the bearing member 23 to the left and right side frame members 2A and 2B of the door frame 2.

The door frame 2 to which the first and second connecting fittings 20A and 20B are attached in the factory is transported to a construction site where the hinged door apparatus shown in FIG. 1 is to be installed. After that, before the face plates 6 (see FIG. 4) of the wall 4 (see FIG. 2) are attached to the core members 5, the first and second connecting fittings 20A and 20B are inserted into the horizontal interval between the auxiliary member 8 and the left and right side frame members 2A and 2B of the door frame 2, and the first connecting fitting 20A is inserted into the vertical interval between the auxiliary member 8 and the upper frame member 2C of the door frame 2. Consequently, the door frame 2 and the first and second connecting fittings 20A and 20B are arranged inside the opening 4A of the wall 4 shown in FIGS. 1 and 2. In this state, the auxiliary member 8 is attached to the reinforcing member 7 coupled with the core members 5A, 5B, and 5C (see FIG. 3), thereby forming the wall 4 shown in FIG. 2. Note that the work for attaching the auxiliary member 8 to the reinforcing member 7 is performed immediately before the work for arranging the door frame 2 and the first and second connecting fittings 20A and 20B inside the opening 4A of the wall 4 as described above.

In this embodiment, when performing the work for arranging the door frame 2 and the first and second connecting fittings 20A and 20B inside the opening 4A of the wall 4 as described above, for the first connecting fitting 20A, among the plurality of first connecting fittings 20A, which is inserted into the horizontal interval between the auxiliary member 8 and the side frame members 2A and 2B of the door frame 2, the parallelizing function of the parallelizing means 45 described above can make the first and second connecting members 21 and 22 parallel or almost parallel to each other while aligning the first and second connecting members 21 and 22 in the vertical direction perpendicular to the horizontal direction as the interval between the reinforcing member 7 and the side frame members 2A and 2B, and to the thickness direction of the door frame 2, even when the first and second connecting members 21 and 22 can pivot around the central shaft 24. Also, for the first connecting fitting 20A to be inserted into the vertical interval between the upper frame member 2C of the door frame 2 and the auxiliary member 8 attached to the reinforcing member 7 coupled with the core member 5C, the parallelizing function of the parallelizing means 45 can make the first and second connecting members 21 and 22 parallel or almost parallel to each other while aligning the first and second connecting members 21 and 22 in the horizontal direction perpendicular to the vertical direction as the interval between the upper frame member 2C and the reinforcing member 7, and to the thickness direction of the door frame 2.

As described above, therefore, even when the first and second connecting members 21 and 22 of the first connecting fitting 20A are pivotable around the central shaft 24, and the horizontal interval between the reinforcing member 7 and the side frame members 2A and 2B and the vertical interval between the upper frame member 2C and the reinforcing member 7 are small, the first connecting fitting 20A can effectively be inserted into these intervals. This insertion work can be performed by standing up only the first connecting member 21 of the second connecting fitting 20B around the central shaft 24 of the second connecting fitting 20B. Since a few workers can easily finish the insertion work within a short time period, the workability can be improved.

After inserting the plurality of first connecting fittings 20A into the horizontal interval between the auxiliary member 7 and the side frame members 2A and 2B and into the vertical interval between the upper frame member 2C and the reinforcing member 7 as described above, the worker performs the work for pivoting at least one of the first and second connecting members 21 and 22 of each of the first connecting fittings 20A toward the side frame members 2A and 2B or the opposite side of the upper frame member 2C around the central shaft 24 with respect to the other connecting member. This pivoting work can be performed by, e.g., inserting a tool or the like into the second and third holes 29 and 30 of the first connecting member 21 shown in FIGS. 7A, 7B, and 7D, and into the second and third holes 38 and 39 of the second connecting member 22 shown in FIGS. 9A and 9B.

Figure 13:
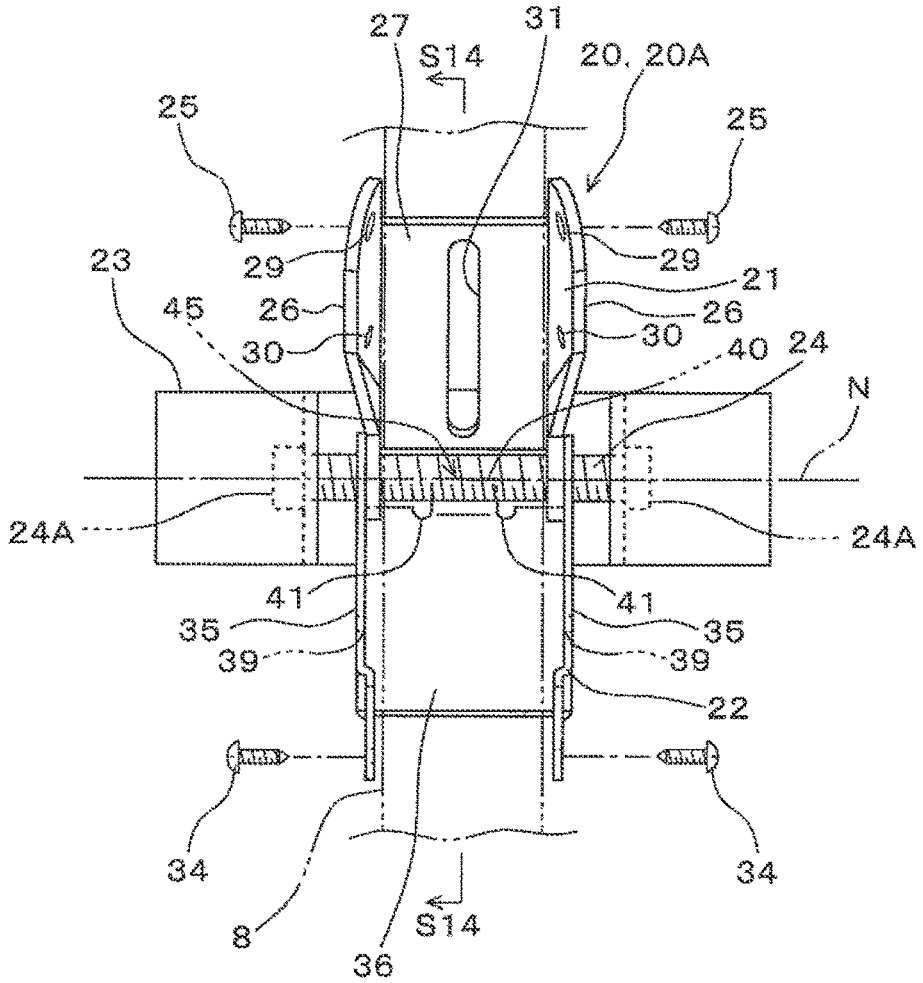
FIG. 13 is a side view showing the first connecting fitting when the first and second connecting members are doglegged as shown in FIGS. 5 and 6.
Figure 14:
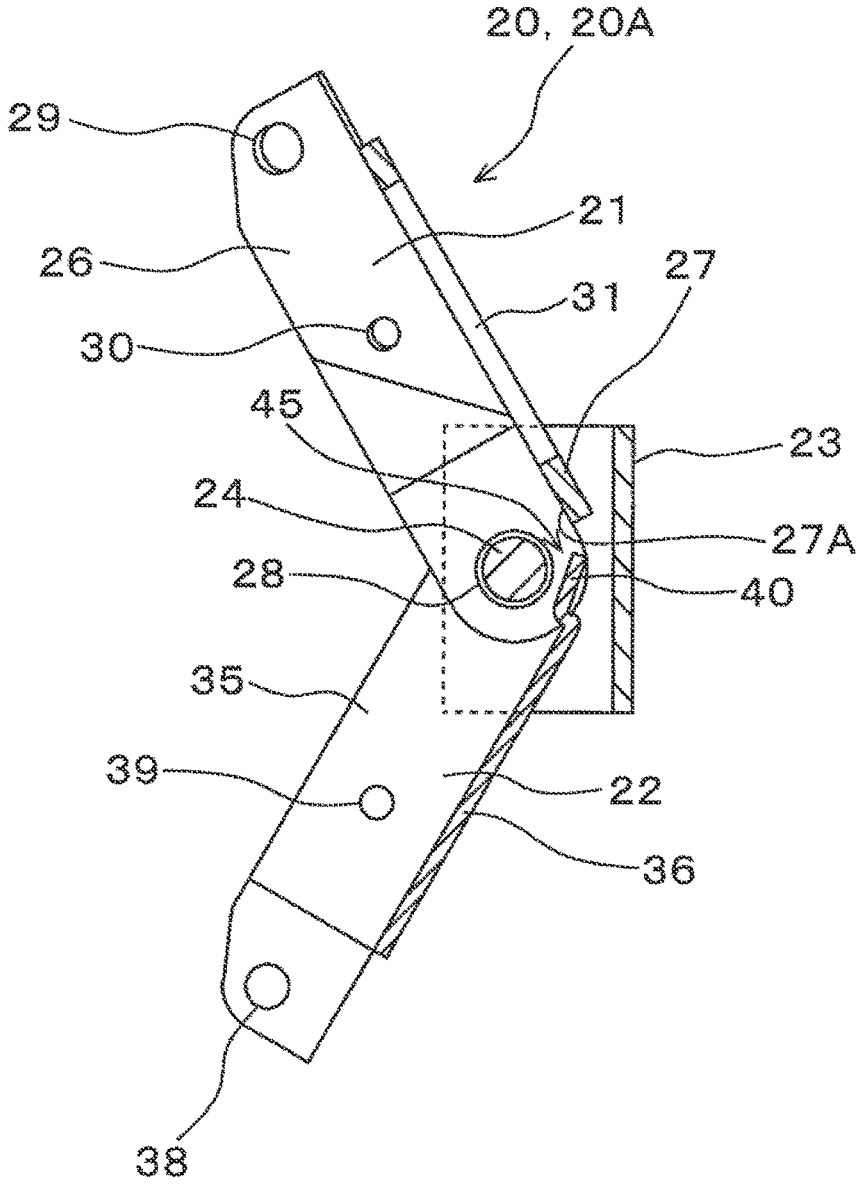
FIG. 14 is a sectional view taken along a line S14-S14 shown in FIG. 13.

FIG. 13 shows the side view of the first connecting fitting 20A after this pivoting work is performed. FIG. 14 is the sectional view of the first connecting fitting 20A taken along a line S14-S14 shown in FIG. 13. As shown in FIG. 14, when the above-described pivoting work is performed, the projecting piece 40 formed in the second connecting member 22 and in contact with the rear surface 27A of the bridge part 27 of the first connecting member 21 bends from the portion connected to the bridge part 36 of the second connecting member 22 due to the load of the pivoting work by the worker, and this eliminates the parallelizing function of the parallelizing means 45. Consequently, for the first connecting fitting 20A, among the plurality of connecting fittings 20A, which is inserted into the interval between the reinforcing member 7 and the side frame members 2A and 2B, the first and second connecting members 21 and 22 are pivoted around the central shaft 24, as indicated by the alternate long and two short dashed lines shown in FIG. 10, such that inclination angles θ1 and θ2 with respect to a horizontal direction M as the direction of the interval between the reinforcing member 7 and the side frame members 2A and 2B are angles in directions opposite to each other. This makes it possible to insert (see FIG. 15) the auxiliary member 8 between the end portions 26A and between the end portions 35A, on the side of the auxiliary member 8, of the two connecting parts 26 and 35 (see FIGS. 7A to 7D and FIG. 9B) of the first and second connecting members 21 and 22. Also, for the first connecting fitting 20A inserted into the interval between the upper frame work 2C and the auxiliary member 8, the first and second connecting members 21 and 22 are pivoted around the central shaft 24 such that inclination angles with respect to the vertical direction as the direction of the interval between the upper frame member 2C and the reinforcing member 7 are angles in directions opposite to each other. This makes it possible to insert the auxiliary member 8 between the end portions 26A and between the end portions 35A, on the side of the auxiliary member 8, of the two connecting parts 26 and 35 of the first and second connecting members 21 and 22.

In each first connecting fitting 20A, therefore, the first connecting member 21 forms an inclination angle with respect to the direction of the interval between the auxiliary member 8 and the side frame members 2A and 2B, and to the direction of the interval between the upper frame member 2C and the auxiliary member 8, and the second auxiliary member 22 forms an inclination angle in a direction opposite to that of the inclination angle of the first auxiliary member, with respect to the direction of the interval between the auxiliary member 8 and the side frame members 2A and 2B, and to the direction of the interval between the auxiliary member 8 and the upper frame member 2C.

Note that in the first connecting fittings 20A, the second connecting member 22 has the two notches 41 formed on the two sides of the projecting piece 40 of the second connecting member 22 as described above. Therefore, the worker can reliably bend the projecting piece 40 even when the load of the above-described pivoting work for bending the projecting piece 40 from the portion connected to the bridge part 36 of the second connecting member 22 is small.

Furthermore, in this embodiment, the central shaft 24 as the constituting member of the first connecting fitting 20A is an insertion member inserted into both the first and second connecting members 21 and 22 of the first connecting member 20A in order to make the first and second connecting members 21 and 22 pivotable. Accordingly, the number of members constituting the first connecting fitting 20A can be reduced compared to a case in which a central shaft for making each of the first and second connecting members 21 and 22 pivotable is used for each of the first and second connecting members 21 and 22. This makes it possible to simplify the structure and reduce the manufacturing cost.

Figure 15:
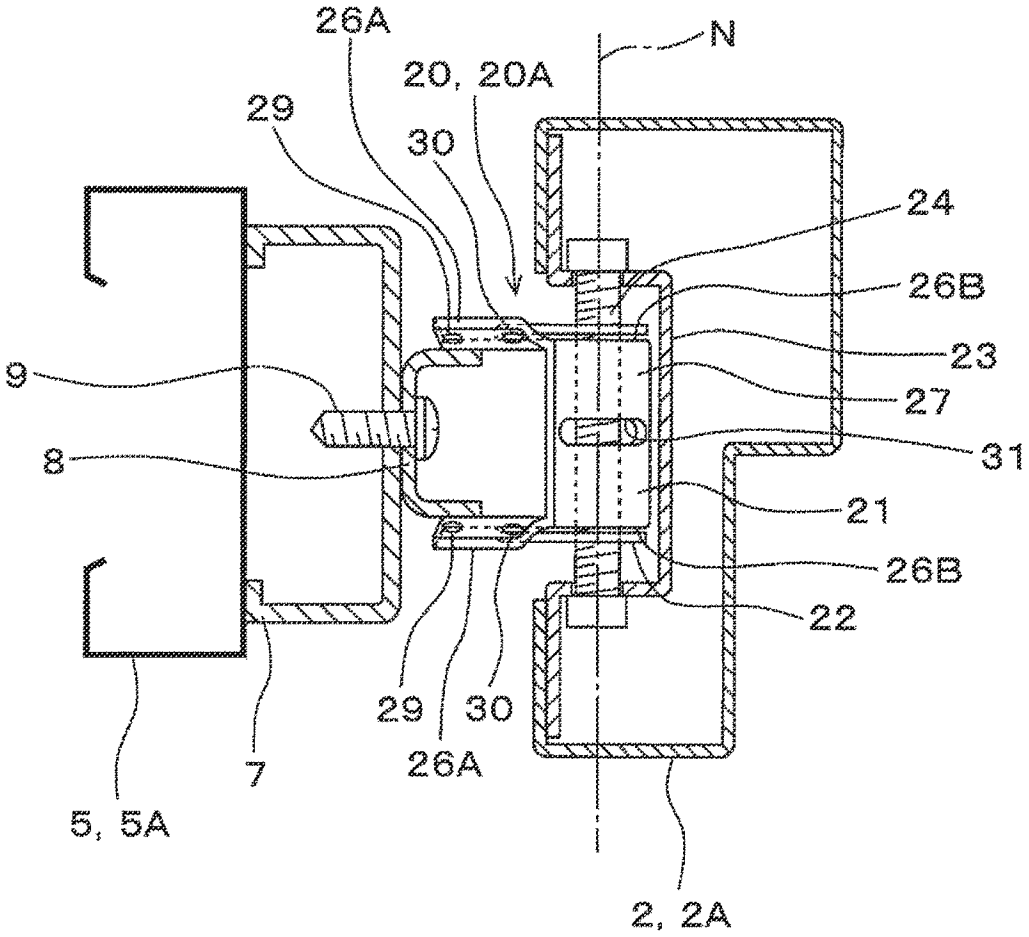
FIG. 15 is a view similar to FIG. 4, showing a state before the first and second connecting members are coupled with the auxiliary member attached to the reinforcing member shown in FIG. 4 by using coupling fittings.

FIG. 15 shows a state in which the auxiliary member 8 is inserted between the end portions 26A and between the end portions 35A, on the side of the auxiliary member 8, of the two connecting parts 26 and 35 in the first and second connecting members 21 and 22 of the first connecting fitting 20A as described above.

Figure 16:
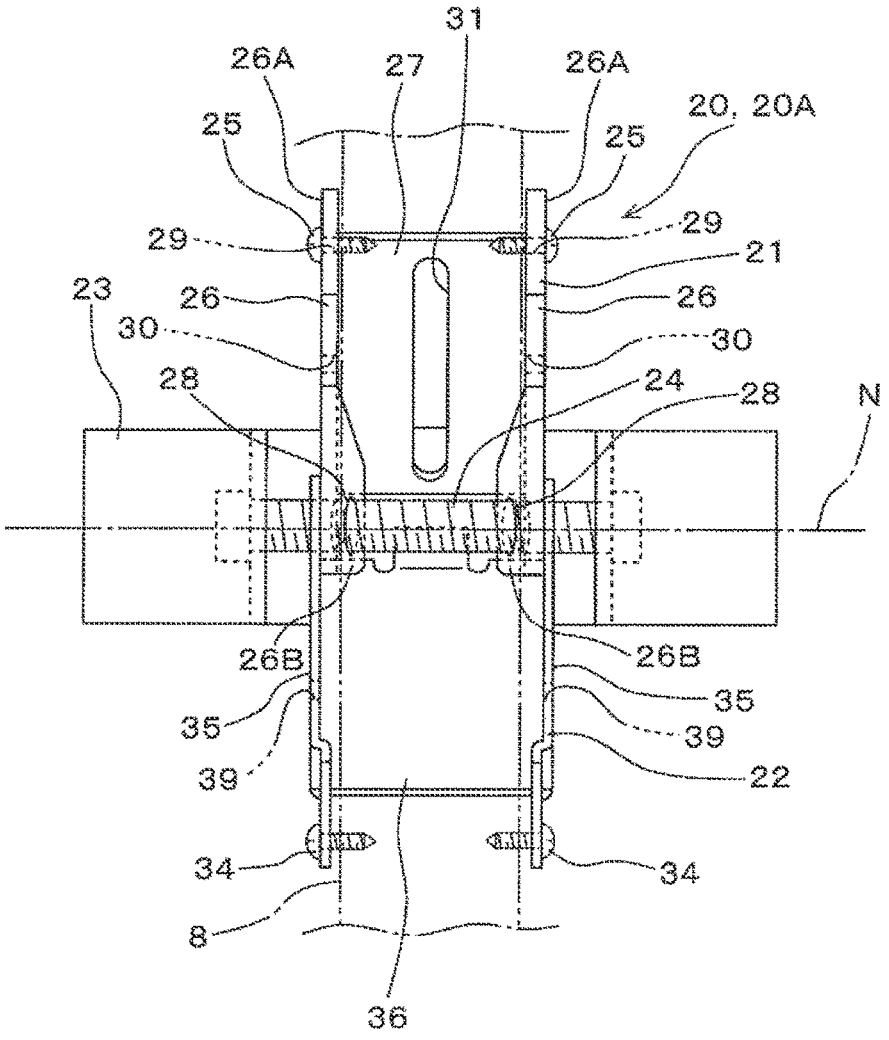
FIG. 16 is a view similar to FIG. 13, showing a state in which the first and second connecting members are coupled with the reinforcing member indicated by the alternate long and two short dashed lines by using the coupling fittings.
Figure 17:
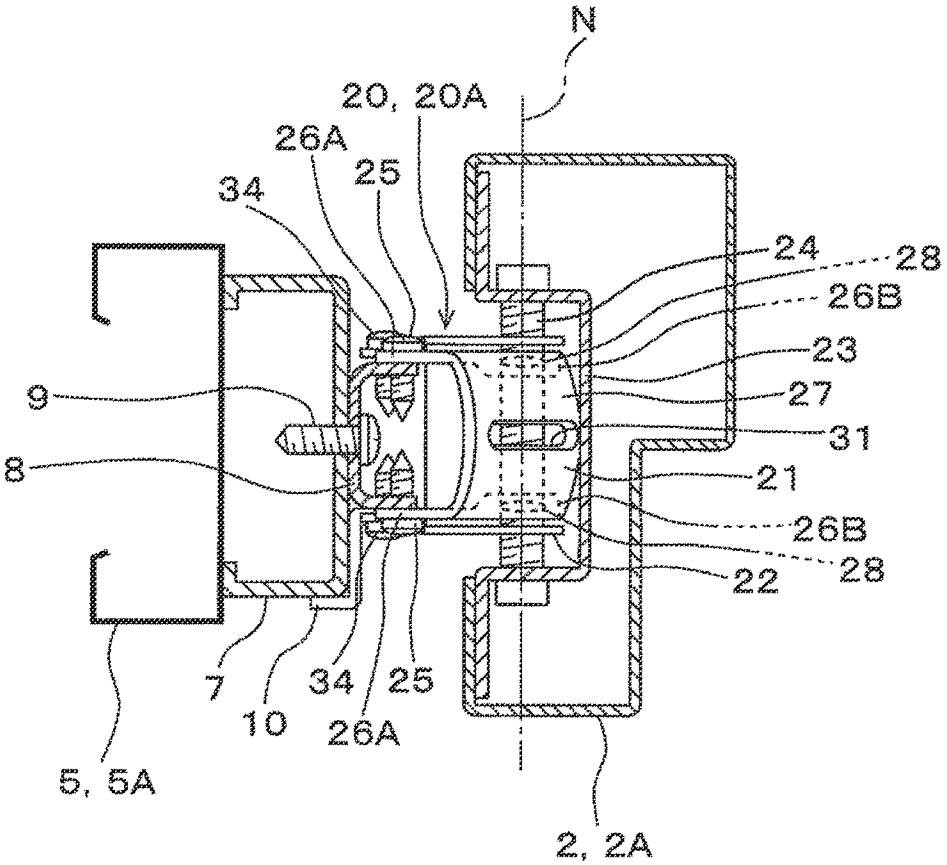
FIG. 17 is a view similar to FIG. 4, showing the state of FIG. 16.

After performing the above-described work, the worker inserts the two coupling fittings 25 (see FIGS. 4 and 13) into the second holes 29 (see FIGS. 7A, 7B, and 7C) formed in the connecting part 26 of the first connecting member 21 of the first connecting fitting 20A (see FIG. 3), and screws the two coupling fittings 25 into the auxiliary member 8, thereby coupling the end portion, on the side of the auxiliary member 8, of the first connecting member 21 with the auxiliary member 8 as shown in FIGS. 16 and 17. Also, the worker inserts the two coupling fittings 34 (see FIGS. 4 and 13) into the second holes 38 (see FIGS. 9A and 9B) formed in the connecting part 35 of the second connecting member 22 of the first connecting fitting 20A, and screws the two coupling fittings 34 into the auxiliary member 8, thereby coupling the end portion, on the side of the auxiliary member 8, of the second connecting member 22 with the auxiliary member 8 as shown in FIGS. 16 and 17.

Furthermore, for each of the two second connecting fittings 20B (see FIG. 3) arranged in the lowermost portions of the left and right side frame members 2A and 2B of the door frame 2, the worker pivots the first connecting member 21 around the central shaft 24, and makes the angle (see FIG. 10) of the first connecting member 21 in above-described horizontal direction M the same as or almost the same as the inclination angle θ1 of the first connecting member 21 of the first connecting fitting 20A described above, and couples the end portion, on the side of the auxiliary member 8, of the first connecting member 21 with the auxiliary member 8 by using the two coupling fittings 25.

Note that the second connecting fittings 20B are formed without using the second connecting member 22 because the second connecting fittings 20B can effectively be arranged in the lowermost portions of the left and right side frame members 2A and 2B by omitting the second connecting member 22 that is supposed to be arranged below the first connecting member 21.

When the coupling work for coupling the first and second connecting fittings 20A and 20B by using the coupling fittings 25 and 34 as described above, the door frame 2 is connected to the auxiliary member 8 via the two connecting portions 26 of the first connecting member 21 and the two connecting parts 35 of the second connecting member 22 of the plurality of first connecting fittings 20A, and connected to the auxiliary member 8 via the two connecting parts 35 of the first connecting member 21 of the two connecting fittings 20B. In this connecting work for connecting the door frame 2 to the auxiliary member 8, the first connecting fitting 20A inserted into the gap between the reinforcing member 7 and the side frame members 2A and 2B has a posture by which the inclination angle θ1 made by the first connecting member 21 in the horizontal direction M as the direction of the gap between the reinforcing member 7 and the side frame members 2A and 2B and the inclination angle θ2 made by the second connecting member 22 in the horizontal direction M are in opposite directions (see FIG. 10). The door frame 2 is connected to the auxiliary member 8 so as to be vertically immobile. Also, in the abovementioned connecting work, the first connecting fitting 20A inserted into the gap between the upper frame member 2C and the auxiliary member 8 has a posture by which the inclination angle made by the first connecting member 21 in the vertical direction as the direction of the gap between the upper frame member 2C and the reinforcing member 7 and the inclination angle made by the second connecting member 22 in the vertical direction are in opposite directions. Accordingly, the door frame 2 is connected to the auxiliary member 8 so as to be immobile in the horizontal direction as well.

Also, as shown in FIGS. 16 and 17, when the end portion (see FIGS. 4 and 13), on the side of the auxiliary member 8, of the first connecting member 21 of the first connecting fitting 20A is coupled with the auxiliary member 8 by the two coupling fittings 25 inserted into the second holes 29 (see FIGS. 7A, 7B, and 7D) formed in the connecting parts 26 of the first connecting member 21, the loads W from the coupling fittings 25 act on the end portions 26A, on the side of the auxiliary member 8, of the connecting parts 26 as explained above with reference to FIGS. 8A, 8B, and 8C. This action of the loads W reduces or eliminates the torsion angle 90°-α having existed in the end portions 26A on the side of the auxiliary member 8, and generates the torsion angles 90°-β in the end portions 26B, on the side of the door frame 2, as the end portions opposite to the end portions 26A as described previously.

Figure 18:
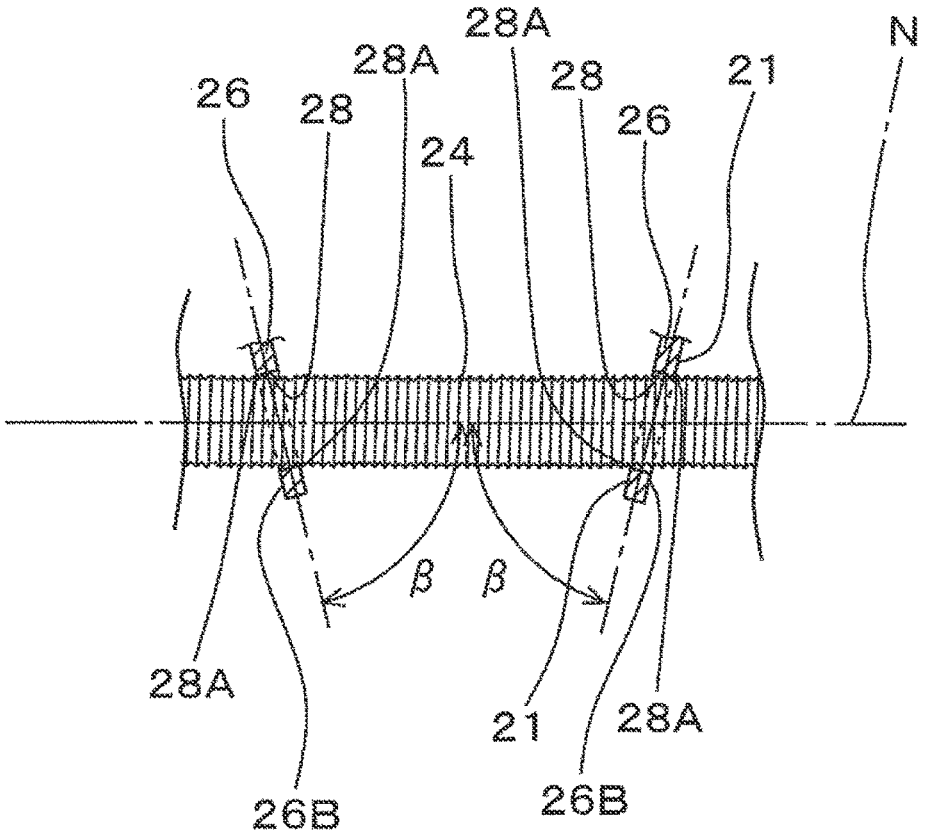
FIG. 18 is an enlarged sectional view showing a state in which the first connecting member of the first connecting fitting is locked by a central shaft as a locked member in the state shown in FIGS. 16 and 17.

FIG. 18 is an enlarged sectional view of the end portions 26B, on the side of the door frame 2, of the connecting parts 26 of the first connecting member 21, and shows that the torsion angles 90°-β as described above form in the end portions 26B. As shown in FIG. 18, when the torsion angle 90°-β forms in the end portion 26B, on the side of the door frame 2, of the connecting part 26 of the first connecting member 21, the torsion angle 90°-β is an angle inclining to a direction perpendicular to the axial direction N of the central shaft 24, so the hole 28 formed as an insertion portion in the end portion 26B on the side of the door frame 2 in order to insert the central shaft 24 also inclines to a direction perpendicular to the axial direction N of the central shaft 24, and a corner 28A of the hole 28 locks on the surface of the central shaft 24. In other words, the central shaft 24 functions as a locked member on which the corner 28A of the hole 28 locks. This locking of the hole 28 onto the locked member makes the first connecting fitting 20A including the first connecting member 21 as a constituting member immobile in the thickness direction of the door frame 2 as the axial direction N of the central shaft 24. Therefore, the door frame 2 is connected to the auxiliary member 8 as a skeleton-side construction material so as to be immobile in the thickness direction of the door frame 2.

In particular, the central shaft 24 as the locked member of this embodiment is a male screw rod on the surface of which many projections and recesses are alternately formed in the axial direction by thread ridges and grooves, the corner 28A of the hole 28 locks on the surface of the central shaft 24 more reliably as described above. Consequently, the door frame 2 can be connected to the auxiliary member 8 such that the door frame 2 is immobile more reliably in the thickness direction of the door frame 2.

In this embodiment, the first and second connecting members 21 and 22 are coupled with the auxiliary member 8 by the coupling fittings 25 and 34 described above. The auxiliary member 8 is attached to the reinforcing member 7 by being set in a predetermined position in the thickness direction of the door frame 2 by the positioning member 10 shown in FIG. 4. Since, therefore, the corner 28A of the hole 28 locks on the surface of the central shaft 24, the door frame 2 is arranged by being set in the predetermined position in the thickness direction of the door frame 2.

In this embodiment as described above, when the load W (see FIGS. 8A and 8B) from the coupling fitting 25 shown in FIG. 4 acts on the end portion 26A, on the side of the auxiliary member 8, of each of the two connecting parts 26 of the first connecting member 21, the bridge part 27 formed in the first connecting member 21 deforms, e.g., curves in a direction projecting to the outside of the first connecting member 21, in the thickness direction of the bridge part 27, and this forms the torsion angle 90°-β in the end portion 26B, on the side of the door frame 2, of the first connecting member 21, as described with reference to FIGS. 8A, 8B, and 8C. In this embodiment, the elongated hole 31 as a strength decreasing portion for decreasing the strength of the bridge part 27 is formed in the bridge part 27. Accordingly, the load W causes deformation, e.g., curving of the bridge part 27 more reliably, and this forms the torsion angle 90°-β of the end portion 26B on the side of the door 2.

In the embodiment explained above, the end portions 26A and 35A, on the side of the auxiliary member 8, of the two connecting parts 26 and 35 of the first and second connecting members 21 and 22 of the first connecting fitting 20A are coupled with the auxiliary member 8 by the two coupling fittings 25 and the two coupling fittings 34. As shown in FIGS. 16 and 17, the coupling fittings 25 and 34 are arranged on the opposite sides in the axial direction N of the central shaft 24 with respect to the first and second connecting members 21 and 22, and couple the end portions 26A and 35A on the side of the auxiliary member 8 with the auxiliary member 8 in opposite directions in the axial direction N of the central shaft 24.

Figure 19:
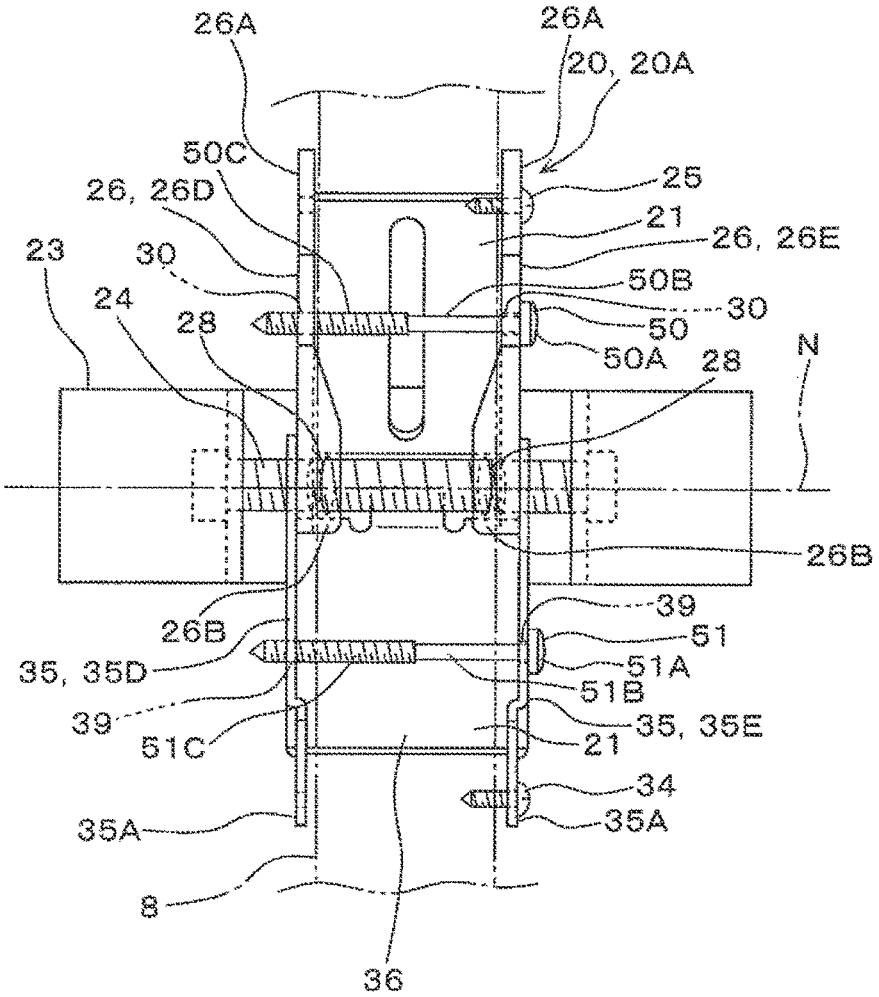
FIG. 19 is a view similar to FIG. 16, showing a state in which the first and second connecting members are coupled with the auxiliary member attached to the reinforcing member by using the coupling fittings arranged on the same side in the axial direction of the central shaft.
Figure 20:
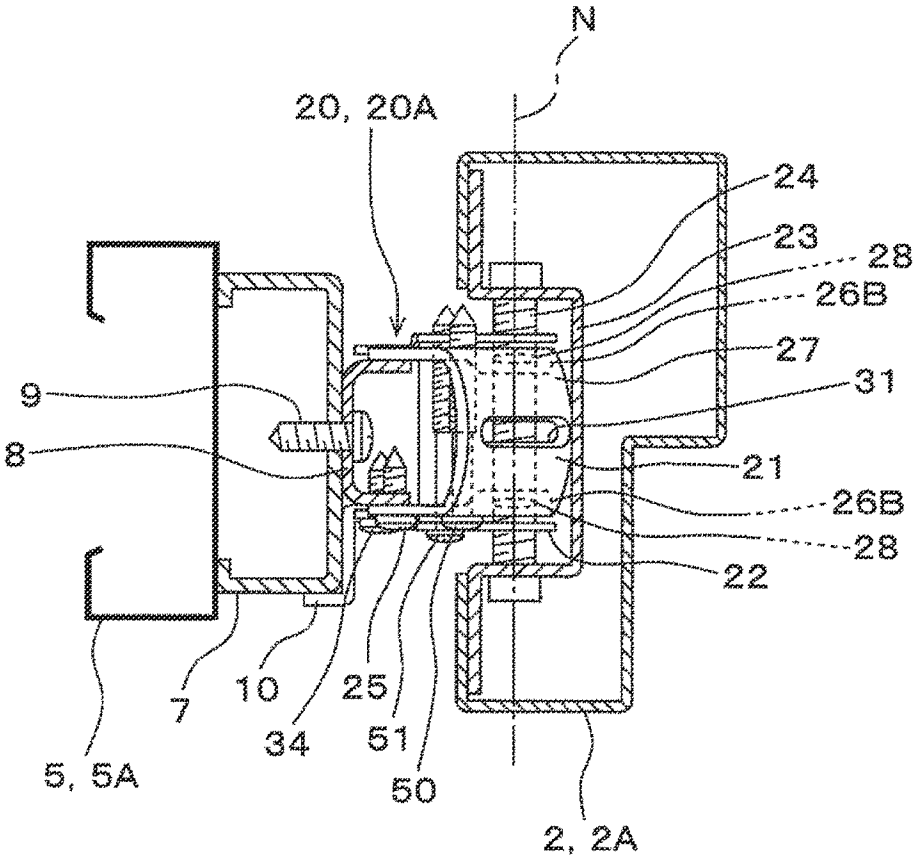
FIG. 20 is a view similar to FIG. 4, showing the state of FIG. 19.

On the other hand, another embodiment shown in FIGS. 19 and 20 uses one coupling fitting 25 and another coupling fitting 50 different from the coupling fitting 25, in order to couple end portions 26A, on the side of an auxiliary member 8, of two connecting parts 26 of a first connecting member 21 of a first connecting fitting 20A, with the auxiliary member 8. The coupling fittings 25 and 50 are arranged on the same side in an axial direction N of a central shaft 24 with respect to the first connecting member 21, and in the same direction along the axial direction N. As shown in FIG. 19, the coupling fitting 50 is a coupling fitting that is inserted into a connecting part 26D, of two connecting parts 26D and 26E, which is arranged on a side opposite to the side on which the coupling fittings 25 and 50 are arranged in the axial direction N of the central shaft 24, and draws the connecting part 26D toward the connecting part 26E. In addition, one coupling fitting 34 and another coupling fitting 51 different from the coupling fitting 34 are used to couple end portions 35A, on the side of the auxiliary member 8, of two connecting parts 35 of a second connecting member 22, with the auxiliary member 8. The coupling fittings 34 and 51 are also arranged on the same side in the axial direction N of the central shaft 24 with respect to the second connecting member 22, and in the same direction along the axial direction N. As shown in FIG. 19, the coupling fitting 51 is a coupling fitting that is inserted into a connecting part 35D, of two connecting parts 35, which is arranged on a side opposite to the side on which the coupling fittings 34 and 51 are arranged in the axial direction N of the central shaft 24, and draws the connecting part 35D toward a connecting part 35E.

As shown in, e.g., FIG. 19, the coupling fittings 50 and 51 are tapping screws including head portions 50A and 51A, small-diameter shaft portions 50B and 51B extending forward from the head portions 50A and 51A, and large-diameter male screw portions 50C and 51C extending forward from the small-diameter shaft portions 50B and 51B. The diameter of third holes 30 and 39 formed in the first and second connecting members 21 and 22 shown in FIGS. 7A to 7D and FIG. 9B is smaller than that of the large-diameter male screw portions 50C and 51C and larger than that of the small-diameter shaft portions 50B and 51B.

Accordingly, when the coupling fittings 50 and 51 are inserted into the third holes 30 and 39 of the connecting parts 26E and 35E, of the pair of connecting parts 26D and 26E and the pair of connecting parts 35D and 35E of the first and second connecting members 21 and 22, and advanced by being rotated by using a tool, female screws are formed on the inner surfaces of the third holes 30 and 39 by the large-diameter male screw portions 50C and 51C. When the coupling fittings 50 and 51 are further advanced by being rotated by using the tool, the large-diameter male screw portions 50C and 51C form female screws in the third holes 30 and 39 of the connecting parts 26D and 35D on the side opposite to the side on which the coupling fittings 25, 34, 50, and 51 are arranged in the axial direction N of the central shaft 24. In this state, the small-diameter shaft portions 50B and 51B of the coupling fittings 50 and 51 have reached the third holes 30 and 39 of the connecting parts 26E and 35E on the same side as the side on which the coupling fittings 25, 34, 50, and 51 are arranged, and the small-diameter shaft portions 50B and 51B are idling in the third holes 30 and 39. On the other hand, the large-diameter male screw portions 50C and 51C draw the connecting parts 26D and 35D on the side opposite to the side on which the coupling fittings 25, 34, 50, and 51 are arranged, toward the connecting parts 26E and 35E on the same side as the side on which the coupling fittings 25, 34, 50, and 51 are arranged.

Consequently, of the end portions 26A and 35A, on the side of the auxiliary member 8, of the two connecting parts 26 and the two connecting parts 35 of the first and second connecting members 21 and 22, the end portions 26A and 35A on the side opposite to the side on which the coupling fittings 25, 34, 50, and 51 are arranged are strongly pressed against the auxiliary member 8. This sets the end portions 26A and 35A in the same state as that when they are coupled with the auxiliary member 8.

In this embodiment, all the coupling fittings 25, 34, 50, and 51 for coupling the end portions 26A and 35A, on the side of the auxiliary member 8, of the connecting parts 26 and 35 of the first and second connecting members 21 and 22 of the first connecting fitting 20A, with the auxiliary member 8 can be arranged on the same side in the axial direction N of the central shaft 24. Therefore, the work for rotating and advancing the coupling fittings 25, 34, 50, and 51 by using a tool can be performed by a worker on the same side in the axial direction N of the central shaft 24. This makes it possible to facilitate the work, shorten the time of the work, and improve the workability of the work.

Note that in the embodiment shown in FIGS. 19 and 20, coupling fittings similar to the coupling fittings 25 and 50 are used to couple the end portions 26A, on the side of the auxiliary member 8, of the two connecting parts 26 of the first connecting member 21 forming the second connecting fitting 20B (see FIG. 3), with the auxiliary member 8.

In this embodiment, the third holes 30 are formed in the two connecting parts 26D and 26E of the first connecting member 21 of the first and second connecting fittings 20A and 20B. Also, the third holes 39 are formed in the two connecting parts 35D and 35E of the second connecting member 22 of the first connecting fitting 20A. Unlike the example shown in FIG. 19, therefore, the coupling fittings 25, 34, 50, and 51 can also be arranged on the side of the connecting part 26D of the first connecting member 21, and on the side of the connecting part 35D of the second connecting member 22. Accordingly, the side on which the coupling fittings 25, 34, 50, and 51 are arranged can freely be selected in accordance with the state of each installation site of the hinged door apparatus. In addition, the work for connecting the door frame 2 to the auxiliary member 8 of the wall 4 can be performed by arranging the coupling fittings 25, 34, 50, and 51 on the same side in the thickness direction of the door frame 2, for the first and second connecting fittings 20A and 20B to be arranged in the left and right side frame members 2A and 2B and the upper frame member 2C of the door frame 2 shown in FIG. 3.

Figure 21:
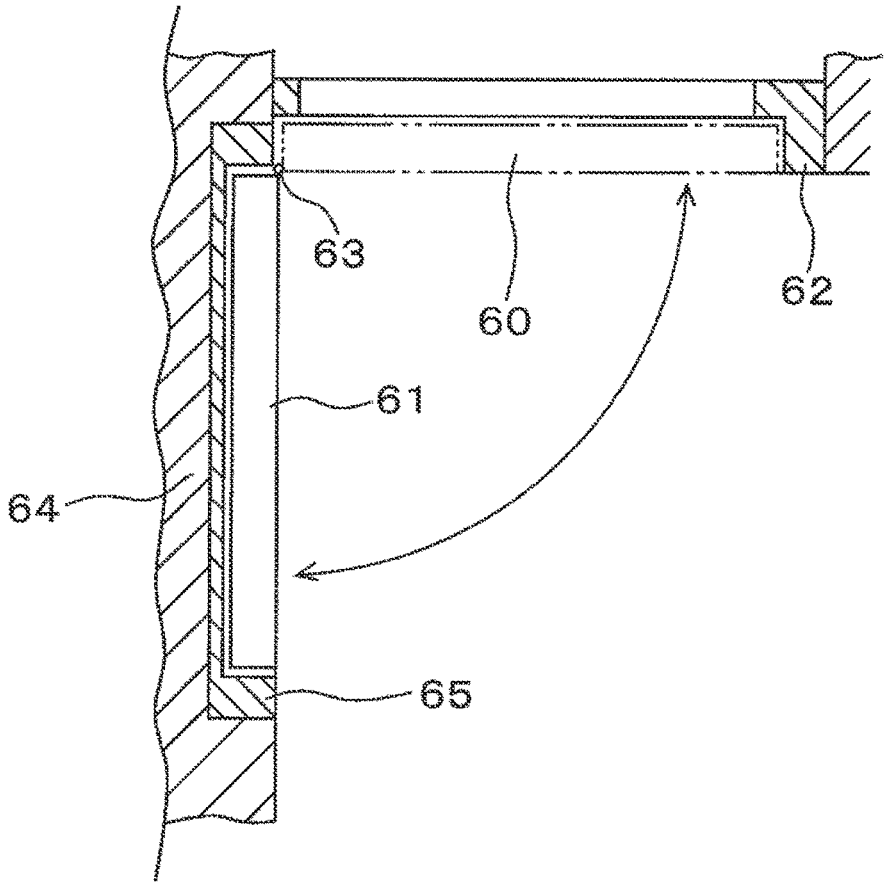
FIG. 21 is a plan sectional view showing the structure of a building to which the coupling fittings shown in FIGS. 19 and 20 are applicable.

FIG. 21 is a plan sectional view showing the structure of a building or the like in which it is effective to arrange all the coupling fittings 25, 34, 50, and 51 on the same side in the axial direction N of the central shaft 24 as explained with reference to FIGS. 19 and 20. In this structure, a fire door 61 that normally opens a doorway 60 inside a door frame 62 is openable/closable around a hinge 63 between the door frame 62 and a door case 65 for accommodating the closed fire door 61. The door case 65 is connected to a back wall 64 having a large thickness. The first and second connecting fittings 20A and 20B and the coupling fittings 25, 34, 50, and 51 shown in FIGS. 19 and 20 are used to connect the door case 65 to the back wall 64. Therefore, even in the structure in which one surface of the door case 65 in the thickness direction is covered with the wall 64, the work for connecting the door case 65 to the back wall 64 can effectively be performed by using the first and second connecting fittings 20A and 20B and the coupling fittings 25, 34, 50, and 51.

INDUSTRIAL APPLICABILITY

The present invention can be used to connect two construction materials spaced apart from each other, more specifically, to connect a construction material of a skeleton such as a wall to an apparatus-side construction material, e.g., an opening frame such as a door frame of a hinged door apparatus, a sliding door apparatus, or the like.

EXPLANATION OF THE REFERENCE NUMERALS AND SIGNS

1 . . . hinged door, 2 . . . door frame as construction material of hinged door apparatus, 2A, 2B . . . side frame member of door frame, 2C . . . upper frame member of door frame, 4 . . . wall as skeleton, 7 . . . reinforcing member as skeleton-side construction material, 8 . . . auxiliary member as skeleton-side construction material, 20 . . . connecting fitting, 20A . . . first connecting fitting, 20B . . . second connecting fitting, 21 . . . first connecting member, 22 . . . second connecting member, 23 . . . bearing member, 24 . . . central shaft that functions as locked member and insertion member, 25, 34, 50, 51 . . . coupling fitting, 26 . . . connecting part, 26A . . . auxiliary-member-side end portion (second end portion) as end portion on side of other construction material, 26B . . . door-frame-side end portion (first end portion) as end portion on side of one constructure material, 27 . . . bridge part, 28 . . . hole that functions as insertion portion for inserting central shaft, 31 . . . elongated hole that functions as strength decreasing portion of bridge part, 90°-α, 90°-β . . . torsion angle, θ1, θ2 . . . inclination angle, M . . . horizontal direction as direction of interval, N . . . axial direction, W . . . load.

The invention claimed is:

1. A connecting member for construction materials, which connects two construction materials arranged with an interval therebetween, the connecting member comprising a connecting part including a first end portion reaching a locked member arranged in one construction material of the two construction materials such that a thickness direction of the one construction material, which is perpendicular to a direction of the interval, is an axial direction, and a second end portion reaching the other construction material of the two construction materials, wherein the second end portion is formed to have a torsion angle as an inclination angle to a direction perpendicular to the axial direction of the locked member, and when the second end portion is coupled with the other construction material and the torsion angle of the second end portion reduces or disappears, a torsion angle as an inclination angle to a direction perpendicular to the axial direction can be generated in the first end portion, and the first end portion locks on the locked member due to the generation of the torsion angle of the first end portion, thereby connecting the two construction materials.

2. The connecting member for construction materials according to claim 1, wherein the connecting part includes an insertion portion formed in the first end portion and configured to insert the locked member.

3. The connecting member for construction materials according to claim 2, wherein the insertion portion is a hole formed in the connecting part.

4. The connecting member for construction materials according to claim 2, wherein the connecting member comprises two connecting parts arranged in the axial direction, and further comprising a bridge part having a widthwise dimension in the axial direction and configured to couple the two connecting parts.

5. The connecting member for construction materials according to claim 4, wherein directions of the torsion angles of the second end portions of the two connecting parts are opposite to each other.

6. The connecting member for construction materials according to claim 4, wherein the bridge part comprises a strength decreasing portion configured to decrease strength of the bridge part.

7. The connecting member for construction materials according to claim 6, wherein the strength decreasing portion is a hole formed in the bridge part.

8. The connecting member for construction materials according to claim 4, wherein coupling fittings for coupling the second end portions of the two connecting parts with the other construction material are arranged on opposite sides of the two connecting parts in the axial direction, and point in opposite directions in the axial direction.

9. The connecting member for construction materials according to claim 4, wherein coupling fittings for coupling the second end portions of the two connecting parts with the other construction material are arranged on a side of one of the two connecting parts, which is opposite to the other connecting part, in the axial direction, couple the two end portions of the two connecting parts with the other construction material in the same direction in the axial direction, and at least one of the coupling fittings draws the other connecting part of the two connecting parts toward the one connecting part.

10. The connecting member for construction materials according to claim 1, wherein the locked member is a member having projections and recesses on a surface.

11. A connecting fitting for construction materials, which connects two construction materials arranged with an interval therebetween, the connecting fitting comprising a first connecting member and a second connecting member each configured to connect the two construction materials, wherein the first connecting member includes a connecting part including a first end portion reaching a locked member arranged in one construction material of the two construction materials such that a thickness direction of the one construction material, which is perpendicular to a direction of the interval, is an axial direction, and a second end portion reaching the other construction material of the two construction materials, the second end portion is formed to have a torsion angle as an inclination angle to a direction perpendicular to the axial direction of the locked member, a torsion angle as an inclination angle to a direction perpendicular to the axial direction can be generated in the first end portion when the second end portion is coupled with the other construction material and the torsion angle of the second end portion reduces or disappears, and the first end portion locks on the locked member due to the generation of the torsion angle, thereby connecting the two construction materials, and the first connecting member and the second connecting member make inclination angles to the direction of the interval, and the inclination angle of the second connecting member to the direction of the interval becomes opposite to the inclination angle of the first connecting member, thereby connecting the two construction materials.

12. The connecting member for construction materials according to claim 11, wherein the locked member is inserted as a common insertion member into the first end portion of each of the first connecting member and the second connecting member.

13. A connecting structure for construction materials, which connects two construction materials arranged with an interval therebetween, the connecting structure comprising a first connecting member and a second connecting member each of which is a member for connecting the two construction materials, wherein the first connecting member includes a connecting part including a first end portion reaching a locked member arranged in one construction material of the two construction materials such that a thickness direction of the one construction material, which is perpendicular to a direction of the interval, is an axial direction, and a second end portion reaching the other construction material of the two construction materials, the second end portion is formed to have a torsion angle as an inclination angle to a direction perpendicular to the axial direction of the locked member, a torsion angle as an inclination angle to a direction perpendicular to the axial direction can be generated in the first end portion when the second end portion is coupled with the other construction material and the torsion angle of the second end portion reduces or disappears, and the first end portion locks on the locked member due to the generation of the torsion angle, thereby connecting the two construction materials, and the first connecting member and the second connecting member make inclination angles to the direction of the interval, and the inclination angle of the second connecting member to the direction of the interval becomes opposite to the inclination angle of the first connecting member, thereby connecting the two construction materials.

14. A connecting method for construction materials, which connects two construction materials arranged with an interval therebetween, wherein the method connects the two construction materials by using a first connecting member and a second connecting member each of which is a member for connecting the two construction materials, wherein the first connecting member includes a connecting part including a first end portion reaching a locked member arranged in one construction material of the two construction materials such that a thickness direction of the one construction material, which is perpendicular to a direction of the interval, is an axial direction, and a second end portion reaching the other construction material of the two construction materials, the second end portion is formed to have a torsion angle as an inclination angle to a direction perpendicular to the axial direction of the locked member, a torsion angle as an inclination angle to a direction perpendicular to the axial direction can be generated in the first end portion when the second end portion is coupled with the other construction material and the torsion angle of the second end portion reduces or disappears, and the first end portion locks on the locked member due to the generation of the torsion angle, thereby connecting the two construction materials, and the first connecting member and the second connecting member make inclination angles to the direction of the interval, and the inclination angle of the second connecting member to the direction of the interval becomes opposite to the inclination angle of the first connecting member, thereby connecting the two construction materials, and the method comprises:

a first working step of inserting the first connecting member and the second connecting member between the two construction materials such that the first connecting member and the second connecting member are arranged parallel or almost parallel to each other in a direction perpendicular to the direction of the interval and to the thickness direction of one of the two construction materials;

a second working step of making the inclination angles of the first connecting member and the second connecting member to the direction of the interval opposite to each other, after the first working step; and a third working step of connecting the two construction materials by the first connecting member and the second connecting member, after the second working step.

* * * * *